US008585032B2

(12) United States Patent
Sano et al.

(10) Patent No.: US 8,585,032 B2
(45) **Date of Patent: *Nov. 19, 2013**

(54) SHEET FOLDING APPARATUS AND IMAGE FORMATION SYSTEM PROVIDED WITH THE APPARATUS

(75) Inventors: Kenichi Sano, Kofu (JP); Hiroki Imazu, Kofu (JP); Shinichi Ito, Kofu (JP); Mizuho Shirakura, Fuefuki (JP); Toshiaki Kagami, Minamikoma-gun (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 369 days.

This patent is subject to a terminal disclaimer.

(21) Appl. No.: 12/926,144

(22) Filed: Oct. 28, 2010

(65) Prior Publication Data

US 2011/0101591 A1 May 5, 2011

(30) Foreign Application Priority Data

Oct. 30, 2009 (JP) ..... 2009-250999
Oct. 30, 2009 (JP) ..... 2009-251000
May 28, 2010 (JP) ..... 2010-123211

(51) Int. Cl.
*B41F 13/56* (2006.01)
*B31F 1/00* (2006.01)

(52) U.S. Cl.
USPC ..... 270/20.1; 270/39.01; 493/433; 493/434; 493/442

(58) Field of Classification Search
USPC ..... 493/424, 433, 434, 435, 442, 443, 446; 270/32, 39.01, 39.06, 39.07, 39.08, 270/20.1
See application file for complete search history.

(56) References Cited

U.S. PATENT DOCUMENTS

| | | | | |
|---|---|---|---|---|
| 6,719,680 | B2 * | 4/2004 | Hosoya et al. | 493/324 |
| 7,502,005 | B2 * | 3/2009 | Kimura | 345/92 |
| 7,712,732 | B2 * | 5/2010 | Horii et al. | 270/32 |
| 7,794,381 | B2 * | 9/2010 | Yamamoto et al. | 493/421 |
| 8,256,757 | B2 * | 9/2012 | Imazu et al. | 270/32 |
| 8,292,283 | B2 * | 10/2012 | Matsuno et al. | 270/39.01 |
| 2002/0086786 | A1 * | 7/2002 | Kamizuru et al. | 493/405 |

FOREIGN PATENT DOCUMENTS

| | | |
|---|---|---|
| JP | S61-002637 | 1/1986 |
| JP | S61-027853 | 2/1986 |
| JP | U H03-035954 | 4/1991 |
| JP | H07-117899 | 5/1995 |
| JP | H07-291487 | 11/1995 |
| JP | U H08-05966 | 2/1996 |

(Continued)

*Primary Examiner* — Ren Yan
(74) *Attorney, Agent, or Firm* — Manabu Kanesaka

(57) ABSTRACT

A sheet folding apparatus for performing folding processing, has a first transport path for guiding a sheet from a carry-in entrance to a carrying-out exit without performing the folding processing; a second transport path for performing the folding processing on the sheet from the carry-in entrance; and a folding processing device disposed in a folding position in the second transport path to fold the sheet from the carry-in entrance. The second transport path is disposed to cross the first transport path, and includes a path end portion for guiding the sheet to the folding position, and another path end portion for guiding the folded sheet from the folding position to a downstream side. The path end portion and the another path end portion are disposed opposite to each other relative to the first transport path.

22 Claims, 16 Drawing Sheets

(56) References Cited

FOREIGN PATENT DOCUMENTS

| | | |
|---|---|---|
| JP | H11-106112 | 4/1999 |
| JP | 2001-002317 | 1/2001 |
| JP | 2004-238201 | 8/2004 |
| JP | 2005-008337 | 1/2005 |
| JP | 2005-231778 | 9/2005 |
| JP | 2006-076776 | 3/2006 |
| JP | 2006-290618 | 10/2006 |
| JP | 2006-335500 | 12/2006 |
| JP | 2007-015785 | 1/2007 |
| JP | 2007-320665 | 12/2007 |
| JP | 2008-007297 | 1/2008 |
| JP | 2008-184324 | 8/2008 |
| JP | 2008-247531 | 10/2008 |
| JP | 2009-018494 | 1/2009 |

* cited by examiner

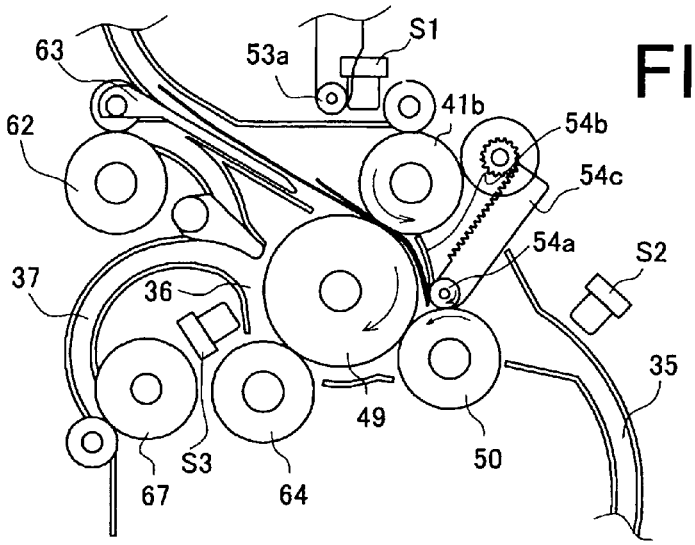
FIG.11(a)
FIG.11(b)
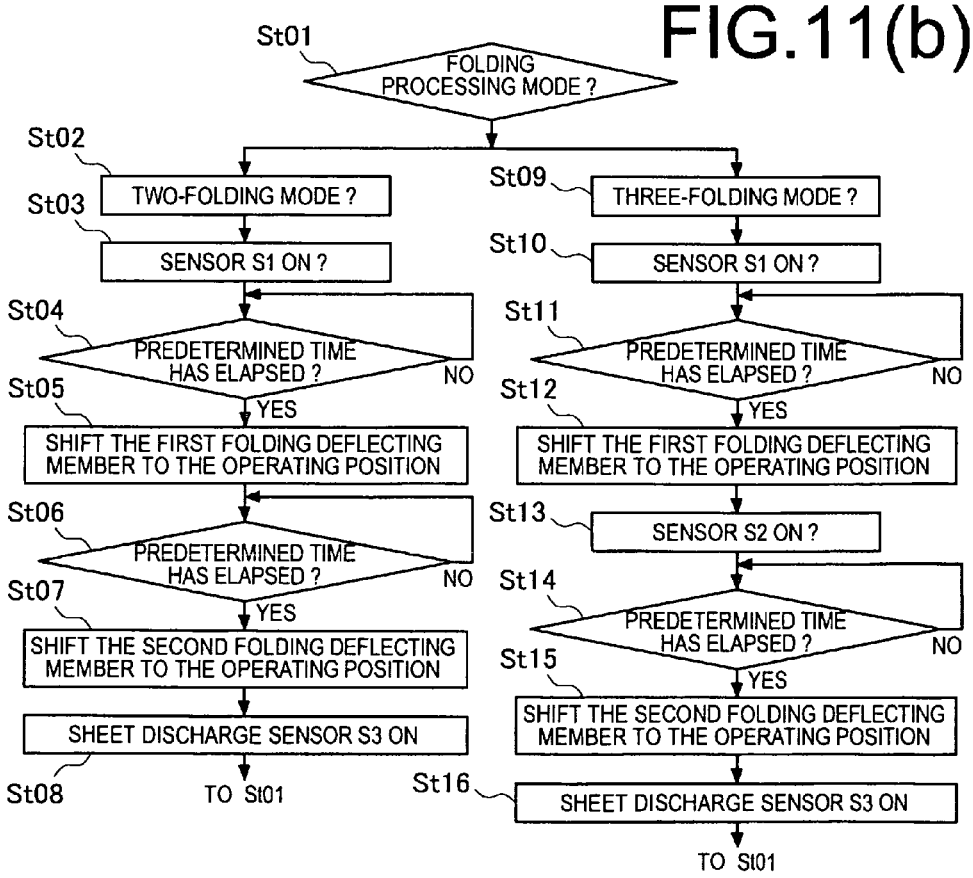

SHEET FOLDING APPARATUS AND IMAGE FORMATION SYSTEM PROVIDED WITH THE APPARATUS

RELATED APPLICATIONS

The present application is based on, and claims priority from Japanese Applications No. 2009-250999, filed Oct. 30, 2009; No. 2009-251000 filed Oct. 30, 2009 and No. 2010-123211 filed May 28, 2010, the disclosure of which is hereby incorporated by reference herein in its entirety.

BACKGROUND OF THE INVENTION

1. Technical Field

The present invention relates to a sheet folding apparatus for folding a sheet with an image formed thereon in half, one-third or the like, for example, and more particularly, to improvements in the folding mechanism, particularly, in the sheet transport path to perform folding processing.

2. Description of the Related Art

Generally, this type of sheet folding apparatus has been known as an apparatus for folding a sheet with an image formed thereon by an image formation apparatus such as a printing press, printer apparatus and copier in a predetermined fold position to perform finish processing. For example, Japanese Patent Application Publication No. 2009-018494 proposes an apparatus which is coupled to a sheet discharge outlet of an image formation apparatus, folds a sheet with an image formed for filing, and carries the sheet out to subsequent binding processing.

The sheet folding apparatus for thus folding a sheet in half or one-third to carry out is configured as a post-processing apparatus of the image formation apparatus, or as a unit incorporated into the image formation apparatus or binding processing apparatus. Then, as a folding form, for example, for filing, various folding forms such as ½ folding, ⅓ Z-folding and ⅓ letter-folding are known corresponding to the intended use.

The folding apparatus which is thus coupled to or incorporated into the image formation apparatus, binding apparatus (finisher apparatus, bookbinding apparatus) or the like requires a path (sheet discharge path) for carrying a sheet out to a carrying-out exit without performing the folding processing on the sheet and another path (folding processing path) for carrying a sheet out to a carrying-out exit after performing the folding processing on the sheet. Therefore, in Japanese Patent Application Publication No. 2009-018494, the sheet discharge path is provided between a carry-in entrance and carrying-out exit formed in an apparatus housing, and the folding processing path is disposed below the sheet discharge path.

Then, in the folding processing path are disposed folding rolls for folding a sheet in ½ or ⅓, and a path for causing the folding rolls to nip the sheet from the fold position. In other words, the sheet is positioned in the shape of a wing with respect to the fold position, inserted in a pair of rollers and folded.

Therefore, in the apparatus in Japanese Patent Application Publication No. 2009-018494, the sheet discharge path is disposed in the horizontal direction of the apparatus, and the folding processing path is disposed above or below in the vertical direction orthogonal to the sheet discharge path. The reason is to make the apparatus housing slim and small in the sheet discharge direction and to save the space of the footprint of the apparatus.

In an apparatus disclosed in Japanese Patent Gazette No. 4144496, a sheet carried out of an image formation apparatus is guided to a folding processing path disposed above or below in the vertical direction orthogonal to the sheet discharge direction, is folded in the path, deflected to the sheet discharge direction, and then, carried out to the outside. Similarly, in an apparatus disclosed in Japanese Patent Gazette No. 4175642, a sheet entering in the horizontal direction from a carry-in entrance is deflected to the vertical direction and guided to a folding processing path.

Thus, in the conventional apparatuses, the folding processing path is arranged in the direction orthogonal to the direction for carrying in and out the sheet. Then, the folding mechanism is disposed in the intermediate position of the path, and the path is provided in the shape of a wing in front and at the back of the folding mechanism so as to match the fold position of the sheet. In consideration of ⅓ folding, the folding processing path is configured in a path length two-thirds the length of the sheet to fold each in front and at the back of the folding mechanism.

As described above, in the conventional sheet folding apparatus, since the folding processing path and the folding mechanism are arranged on one side above or below with respect to the direction for carrying in and out the sheet, there are known a problem that the entire apparatus becomes lager, and another problem that the transport mechanism and the folding mechanism disposed in the path and the driving mechanism therefore also become larger. In other words, since the folding processing path is arranged above or below with respect to the carry-in entrance and carrying-out exit of the sheet, the path requires a path length longer than the sheet length depending on the folding form such as ⅓ folding.

Accordingly, the folding processing path and the folding mechanism occupy almost all of the space inside the apparatus, and the packing density of the processing path affects downsizing of the apparatus. Then, for example, in the conventional apparatus configuration where the folding processing path is arranged below the sheet carry-in/out path, the portion above the sheet carry-in/out path is dead space, and becomes a cause of making the apparatus larger.

Further, in the conventional apparatus, since it is forced to provide the folding mechanism in a position a considerable distance from the sheet carry-in/out path, for example, it is difficult to achieve commonality of the transport mechanism of the sheet carry-in/out path and the transport mechanism of the folding processing mechanism, resulting in increases in complexity and size.

OBJECT OF THE INVENTION

Thus, the inventor of the invention arrived at the idea of splitting the sheet folding path into above and below the sheet carry-in/out path, thereby enabling the occupied space of the path to be high density, and concurrently therewith, enabling the transport mechanism and its driving mechanism to be simplified.

It is a principal object of the invention to provide a sheet folding apparatus for enabling a sheet transport path extending from a carry-in entrance to a carrying-out exit to be made small and compact, and concurrently enabling a mechanism for performing folding processing to be simplified in an apparatus configuration provided with a path without performing the folding processing and another path to perform the folding processing in between the carry-in entrance and the carrying-out exit.

BRIEF SUMMARY OF THE INVENTION

To attain the above-mentioned object, the invention is provided with a first transport path for carrying a sheet without performing folding processing and a second transport path for performing folding processing on a sheet and carrying the sheet to a carrying-out exit in between a carry-in entrance and the carrying-out exit disposed opposite each other, and folding processing means for folding the sheet located in the second transport path. Then, with respect to a path end portion of the second transport path for guiding a sheet to a fold position of the folding processing means and another path end portion for guiding the folded sheet to the downstream side from the fold position, the invention is characterized in that the second transport path and the first transport path cross each other so that one of the end portions is arranged above the other one and that the other one is arranged below the one.

The configuration will specifically be described below. An apparatus for performing folding processing on a sheet from a carry-in entrance (30) to carry out to a carrying-out exit (31) is provided with a first transport path (32) for guiding a sheet from the carry-in entrance (30) to the carrying-out exit (31) without performing folding processing, a second transport path (33) for performing the folding processing on a sheet from the carry-in entrance to guide to the carrying-out exit, and folding processing means (48) disposed in the second transport path to fold the sheet from the carry-in entrance.

Then, the second transport path (33) is disposed to cross the first transport path (32), and a path end portion (first switchback path 34 described later) of the second transport path 33 for guiding the sheet to a folding position Np1 and another path end portion (second switchback path 35 described later) for guiding the folded sheet to the downstream side from the folding position Np1 are disposed inside areas opposite each other below and under or to the left and right of the first transport path 32.

Further, for example, the first transport path (32) is formed of a substantially linear path in the horizontal direction across the apparatus housing, the second transport path (33) is configured so that each of the first switchback path for feeding the sheet to a folding position for first folding and the second switchback path for carrying the first-folded sheet to another folding position for second folding is curved and formed substantially in an S-shaped path, for example, and it is thereby possible to save the space of the footprint of the folding processing path.

The invention provides, in between the carry-in entrance and the carrying-out exit, the first transport path for carrying out a sheet without performing the folding processing, the second transport path for performing the folding processing on a sheet to carry out, and the path end portion for feeding the sheet to the folding position and another path end portion for guiding the folded sheet from the folding position to the downstream side arranged so that one of the path end portions is positioned above the first transport path and that the other path end portion is positioned below the first transport path, and therefore, has the following effects.

With respect to the first transport path for carrying out a sheet without performing the folding processing, since the folding processing path (second transport path) having a path length longer than that of the first transport path is arranged so that one of the path end portions is above the other one and that the other one is below the one, it is possible to densely provide the path configuration occupying inside the apparatus housing, and therefore, the apparatus can be made small and compact.

Further, the folding mechanism such as folding rolls arranged in the center portion of the folding processing path is arranged near the first transport path, and therefore, for example, it is possible to use the path open/close mechanism disposed in the folding mechanism portion for sheet jam processing as the path open/close mechanism of the first transport path for sheet jam processing. Concurrently therewith, for example, it is possible to use the folding rolls as sheet transport rollers of the first transport path, and it is thus possible to simplify the sheet transport mechanism and the folding processing mechanism using simplified structures.

Furthermore, in the invention, in the folding processing path, the first switchback path for guiding the sheet front end for first folding is disposed above the first transport path, the second switchback path for guiding the front end of the folded sheet for second folding is disposed below the first transport path, a storage stacker for storing folding-finished sheets is disposed below the second transport path, and it is thereby possible to further make the apparatus small and compact. In other words, the first switchback path requiring the long path length is disposed above, the second switchback path with the short path length and storage stacker are disposed below, and it is thereby possible to intend more denser packing inside the apparatus housing.

BRIEF DESCRIPTION OF THE SEVERAL VIEWS OF THE DRAWINGS

FIG. 11 contains state explanatory views of the sheet folding operation, where FIG. 11(*a*) is an explanatory view illustrating action of a second folding deflecting member for guiding the sheet front end to the second nip portion in executing a two-folding mode, and FIG. 11(*b*) is a flowchart illustrating folding processing operation;

DETAILED DESCRIPTION OF THE INVENTION

Figure 1:
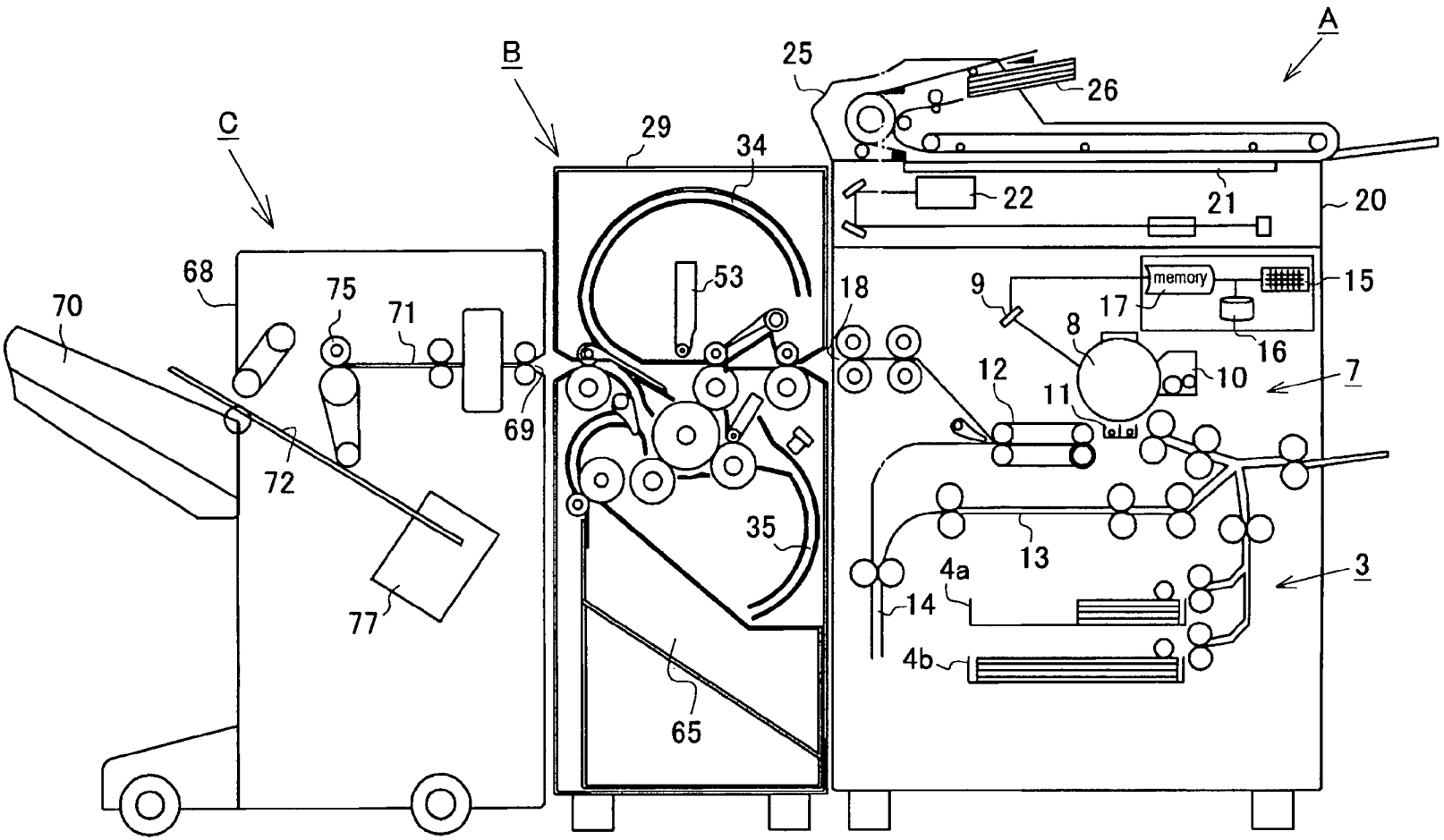
FIG. 1 is an explanatory view of the entire configuration of an image formation system according to the invention.

The invention will specifically be described below based on Embodiments shown in the figures. FIG. 1 shows an image formation system according to the invention. This system is comprised of an image formation apparatus A and a post-processing apparatus C, and the post-processing apparatus C is installed with a sheet folding apparatus B as a unit.

The image formation apparatus A is configured as a printer, copier, printing press or the like for sequentially forming images on sheets. The apparatus as shown in the figure is comprised of an image formation section 7, original document reading section 20 and feeder section (original document feeding apparatus) 25 as a complex copying machine having the copier function and the printer function. Further, the post-processing apparatus C is coupled to a main-body sheet discharge outlet 18 of the image formation apparatus A, and is configured to perform post-processing such as folding processing, punching processing, sealing processing and binding processing on a sheet with an image formed. Then, the post-processing apparatus C is integrally provided with the folding processing unit (sheet folding apparatus) B for performing folding processing on a sheet with an image formed. The sheet folding apparatus B, image formation apparatus A and post-processing apparatus C will be described below in this order.

[Sheet Folding Apparatus]

The sheet folding apparatus B is incorporated into the image formation apparatus A or the post-processing apparatus C, or is configured as an apparatus (stand-alone configuration) independent of the apparatuses. The apparatus as shown in the figure is disposed between the image formation apparatus A and the post-processing apparatus C to constitute the image formation system. Then, the sheet folding apparatus B is attached to the post-processing apparatus C as an optional unit (the configuration will be described later).

Figure 3:
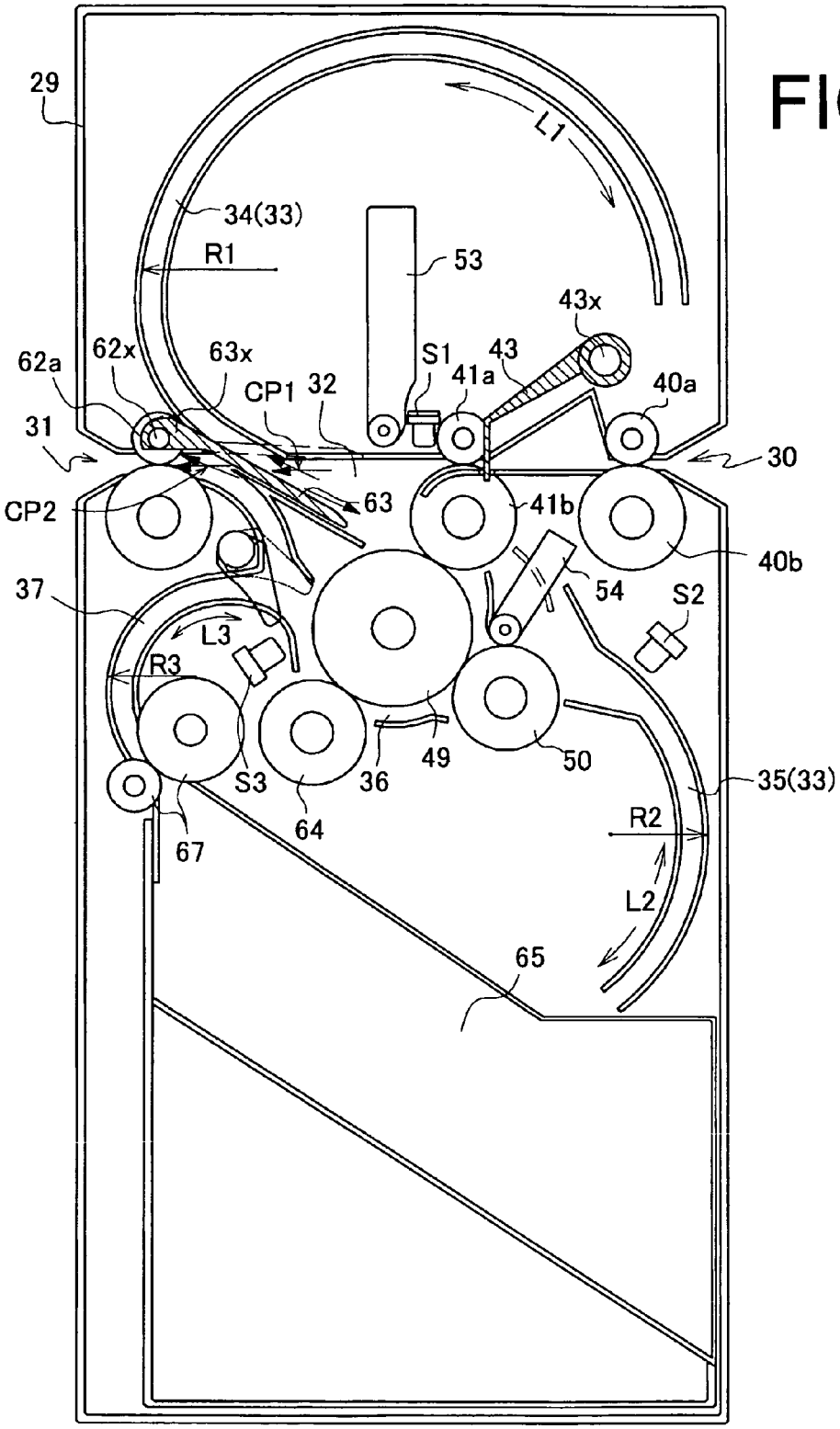
FIG. 3 is an explanatory view of the entire configuration of a sheet folding apparatus in the system of FIG. 1.

Therefore, in the sheet folding apparatus B, as shown in FIG. 3 illustrating the entire configuration, an apparatus housing 29 is provided with a carry-in entrance 30 and a carrying-out exit 31, the carry-in entrance 30 is arranged in a position continued to the main-body sheet discharge outlet 18 of the image formation apparatus A on the upstream side, and the carrying-out exit 31 is arranged in a position continued to a sheet receiving opening 69 of the post-processing apparatus C on the downstream side. As shown in FIG. 3, the carry-in entrance 30 and carrying-out exit 31 are disposed opposite each other across the apparatus housing 29.

Then, in between the carry-in entrance 30 and the carrying-out exit 31 are disposed a first transport path 32 for carrying out a sheet from the carry-in entrance 30 without performing folding processing, and a second transport path 33 for performing the folding processing on a sheet from the carry-in entrance 30 to carry out to the carrying-out exit 31. In this path are disposed a "transport mechanism" for carrying the sheet in the predetermined direction and a "folding processing mechanism" for performing the folding processing on a sheet.

[Path Configuration]

As shown in FIG. 3, in the apparatus housing 29, the first transport path (hereinafter, referred to as a "first path") 32 is disposed between the carry-in entrance 30 and the carrying-out exit 31. This path may be a linear path disposed in the horizontal direction as shown in the figure, may be configured as a curved path, or may be disposed in the vertical direction, and it is possible to adopt any configuration. As described above, the first path 32 guides a sheet from the carry-in entrance 30 to the carrying-out exit 31 without performing the folding processing.

Further, the second transport path (hereinafter, referred to as a "second path") 33 is configured as a path for performing the folding processing on a sheet from the carry-in entrance 30. The second path 33 is provided with folding processing means 48 described later disposed in a folding position Np1 (Np2), and is comprised of a first switchback path 34 for guiding the sheet front end for first folding to the folding position (first nip portion described later), and a second switchback path 35 for guiding the folded sheet front end to the folding position (second nip portion described later) Np2 to perform second folding on the folding-processed sheet. Then, the second path 33 is connected to a third transport path (hereinafter, referred to as a "third path") 36 for carrying out the folded sheet from the second nip portion Np2 toward the carrying-out exit 31.

The second path 33 is comprised of a path end portion which crosses the first path 32 and guides the sheet to above the first path 32, and another path end portion for guiding the sheet to below the first path 32. In the Embodiment as shown in FIG. 3, the first switchback path 34 for guiding the sheet front end to the first nip portion Np1 for folding processing is disposed above the first path 32, and the second switchback path 35 for guiding the folding-processed sheet to the downstream side is disposed below the first path 32.

Thus, the first path 32 and the second path 33 are configured to cross each other, and the first switchback path 34 for guiding the sheet to the first folding position (first nip portion described later) Np1 may be disposed below the first path 32, while the second switchback path 35 for guiding the folding-processed sheet to the downstream side may be disposed above the first path 32.

Further, when the first path 32 is configured in the vertical direction, it is configured that the first switchback path 34 is disposed to the right (or left) of the first path 32 in the vertical direction, and that the second switchback path 35 is disposed to the left (or right) of the path 32. In addition, in the Embodiment as shown in FIG. 3, in relation to the second switchback path 35 guiding the folded sheet to the second nip portion Np2 to perform second folding on the sheet, the path 35 is configured to reverse the feeding direction of the sheet, but when second folding is not performed on the sheet, the path 35 can be a path to extend straight.

The second path 33 is connected to the third path 36 for guiding the folding-processed sheet to the carrying-out exit 31. The third path 36 shown in the figure is provided in between the second nip portion Np2 for performing second folding on the sheet and the carrying-out exit 31. In the third path 36 is disposed a sheet discharge path 37 for guiding the folded sheet to a storage stacker 65 from a sheet discharge outlet 51 different from the carrying-out exit 31.

The first switchback path 34 configured as described above is formed of a path curved in the shape of an arc having the curvature R1 as shown in FIG. 3, and the second switchback path 35 is formed of a path curved in the shape of an arc having the curvature R2 as shown in FIG. 3. Further, the sheet discharge path 37 continued to the third path 36 is formed of a path curved in the shape of an arc having the curvature R3 as shown in FIG. 3.

Then, a path length (L1) of the first switchback path 34 for guiding a sheet from the first path 32 to the first folding position (first nip portion) Np1 and a path length (L2) of the second switchback path 35 for guiding the folded sheet subjected to first folding to the second folding position (second nip portion) Np2 are configured so that path length L1>path length L2.

A path length L3 of the sheet discharge path 37 for guiding the sheet further subjected to the folding processing to the storage stacker 65 from the second nip portion Np2 is configured so that L3<L2<L1. This is because when the first folding position (first nip portion) Np1 is disposed near the first path 32, the path lengths are L3<L2<L1 as a result, and the path configuration is thereby made compact.

Then, the first switchback path 34 is comprised of an arc-shaped path with the curvature R1, the second switchback path 35 is comprised of an arc-shaped path with the curvature R2, and the sheet discharge path 37 is comprised of an arc-shaped path with the curvature R3. The curvature of the first switchback path 34 is set to be larger than that of the second switchback path 35 (curvature R1>curvature R2).

Accordingly, frictional resistance of a sheet passing through the first switchback path 34 with the larger curvature is lower than frictional resistance of a sheet passing through the second switchback path 35 with the smaller curvature. The curvature R3 of the sheet discharge path 37 for guiding the sheet further subjected to the folding processing to the storage stacker 65 is set so that curvature R3<curvature R2<curvature R1. Accordingly, frictional resistance of a sheet passing through each path is first switchback path 34<second switchback path 35<sheet discharge path 37.

Meanwhile, for the nerve of a sheet, a single sheet passing through the first switchback path 34 is the lowest, a first-folded sheet passing through the second switchback path 35 is medium, and a second-folded sheet passing through the sheet discharge path 37 is the highest. Accordingly, by setting the curvature of each path at the above-mentioned conditions corresponding to the nerve of the sheet to carry, the space occupied by the paths is minimized without resulting in a sheet jam.

The first switchback path 34 and second switchback path 35 constituting the second path 33 are formed in the shape of an S-curve as shown in FIG. 3. Further, the sheet discharge path 37 extending to the storage stacker 65 from the second switchback path 35 is formed in the shape of an inverse-S-curve. The storage stacker 65 is disposed below the second switchback path 35, and is coupled with the sheet discharge path 37.

Accordingly, the first switchback path 34 with the longest path length is disposed above the first path 32, the second switchback path 35 and the sheet discharge path 37 with the shorter path lengths are disposed below the first path 32, and the storage stacker 65 is disposed further below. By such a layout configuration, it is possible to make the inside space of the apparatus housing 29 compact.

[Folding Processing Means]

In the second path 33 is disposed the folding processing means 48 for performing the folding processing on a sheet. The folding processing means 48 is comprised of folding roll pairs 41*b*, 49, 50 for folding the sheet in two or three, and folding deflecting means 53, 54 for guiding a fold of the sheet to the nip portion Np1 (Np2). Then, the means 48 is comprised of a pair of two rolls and a single folding deflecting means in a folding form for folding the sheet in two, while being comprised of pairs of three or four rolls and two folding deflecting means in a folding form for folding the sheet in three.

In the apparatus as shown in FIG. 3, in relation to the three-folding form for performing first folding on a sheet and then performing second folding on the sheet, the folding roll pairs are comprised of the first roll 41*b*, second roll 49 and third roll 50 forming the first nip portion Np1 and the second nip portion Np2. Then, the folding deflecting means is comprised of a first folding deflecting member 53 and second folding deflecting member 54. The folding processing mechanism for the three-folding form will be described below.

[Path Switching Means]

As described above, the first path 32 and the second path 33 are disposed to cross each other, the first switchback path 34 is disposed above the first path 32, the second switchback path 35 is disposed below the first path 32, and the second path 33 is connected to the third path 36 for returning the folded sheet from the second nip portion Np2 to the first path 32.

Then, in these paths, as shown in FIG. 3, the first path and the second path cross each other in Cp1, and the third path and the first path cross each other in Cp2. Then, required are a path switch for guiding a sheet to the first switchback path 34 from the first path 32, a path guide for guiding the sheet to the second switchback path 35 from the first switchback path 34, and a path guide for guiding the sheet to the first path 32 from the second switchback path 35.

The apparatus as shown in the figure is characterized in that the above-mentioned three-direction guides are comprised of a single path switching means 63. In the first path 32 is disposed the path switching means 63 in a cross point with the second path 33. As shown in FIG. 3, the path switching means 63 is axially supported at a base end portion 63*x* swingably by the apparatus frame (spindle 62*x* of the carrying-out roller 62*a* in the apparatus shown in the figure) as shown in FIG. 3, and has a front-side guide surface 63*a* and back-side guide surface 63*b* formed in the front end portion.

Then, the front-side guide surface 63*a* guides the sheet fed to the first path 32 to the first switchback path 34 of the second path 33 from the first path 32 in the solid-line attitude in FIG. 3. Concurrently therewith, the back-side guide surface 63*b* sends the folded sheet fed to the third path 36 back to the first path 32. Further, the path switching means 63 directly sends the sheet fed to the first path 32 to the carrying-out exit 31 without carrying the sheet in the second path 33 in the dashed-line attitude in FIG. 3.

As described above, in other words, the second transport path crosses the first transport path in Cp1 to carry in a sheet from the carry-in entrance, the third transport path crosses in the second cross point Cp2 to carry the folding-processing sheet out to the carrying-out exit, and the path switching means 63 for switching the transport direction of the sheet is disposed in the first cross point Cp1 and the second cross point Cp2. Then, the path switching means 63 is comprised of a path switching member (plate-shaped guide piece) 63 that enters and retracts from the first path, and guides the sheet from the first path 32 to the second path 33 by its front-side guide surface 63*a*, while further guiding the sheet from the third path 33 to the first path 32 by its back-side guide surface 63*b*.

The path switching member 63 is provided with driving means (operating solenoid; not shown in the figure) for changing the attitude between the first guide attitude (dashed line in FIG. 3) for directly sending the sheet from the carry-in entrance 30 to the carrying-out exit 31 in the first path 32 and the second guide attitude (solid line in FIG. 3) for guiding the sheet that is fed to the first path from the carry-in entrance 30 to the second transport path while guiding the sheet fed from the third path 36 to the first path 32. In other words, the path switching means 63 shown in the figure is comprised of the plate-shaped piece that swings on the spindle 62*x*, and is coupled at the base end portion to the operating solenoid and return spring.

Thus, the path switching member 63 guides the sheet from the first path 32 to the first switchback path 34 in the second guide attitude, and further guides the sheet from this switchback path to the first nip portion Np1. Concurrently therewith, it is a feature that the member 63 sends the folded sheet from the third path 36 back to the first path 32 in the second guide attitude.

[Configuration of Folding Rolls]

In the second path 33 are disposed the first roll 41*b*, second roll 49 and third roll 50 to come into press-contact with one another. The first nip portion (first folding position) Np1 for first folding the sheet is formed in a press-contact point between the first roll 41*b* and second roll 49, and the second nip portion (second folding position) Np2 for second folding the sheet is formed in a press-contact point between the second roll 49 and the third roll 50.

Particularly, in the apparatus as shown in the figure, the periphery of the first roll 41*b* is disposed in a position facing the first path 32, and a pinch roller (floating roller) 41*a* is brought into press-contact with the roll periphery. By this means, the sheet in the first path 32 is carried by the first roll 41*b* and the pinch roller 41*a*, and it is not necessary to provide a particular transport member and its driving mechanism in the first path 32.

Meanwhile, in the roll diameter of each of the first, second and third rolls, the second roll diameter is the maximum, and for example, 30 mm, the first and third roll diameters are 20 mm, the second roll 49 positioned at the center is configured to have the maximum diameter (for example, 1.5 time), and the reason will be described later. Further, the second roll 49 is brought into press-contact with a folding enhance roller (driving roller) 64 on the downstream side of the press-contact point with the third roll 50.

[Configuration of the Folding Deflecting Means]

Figure 4:
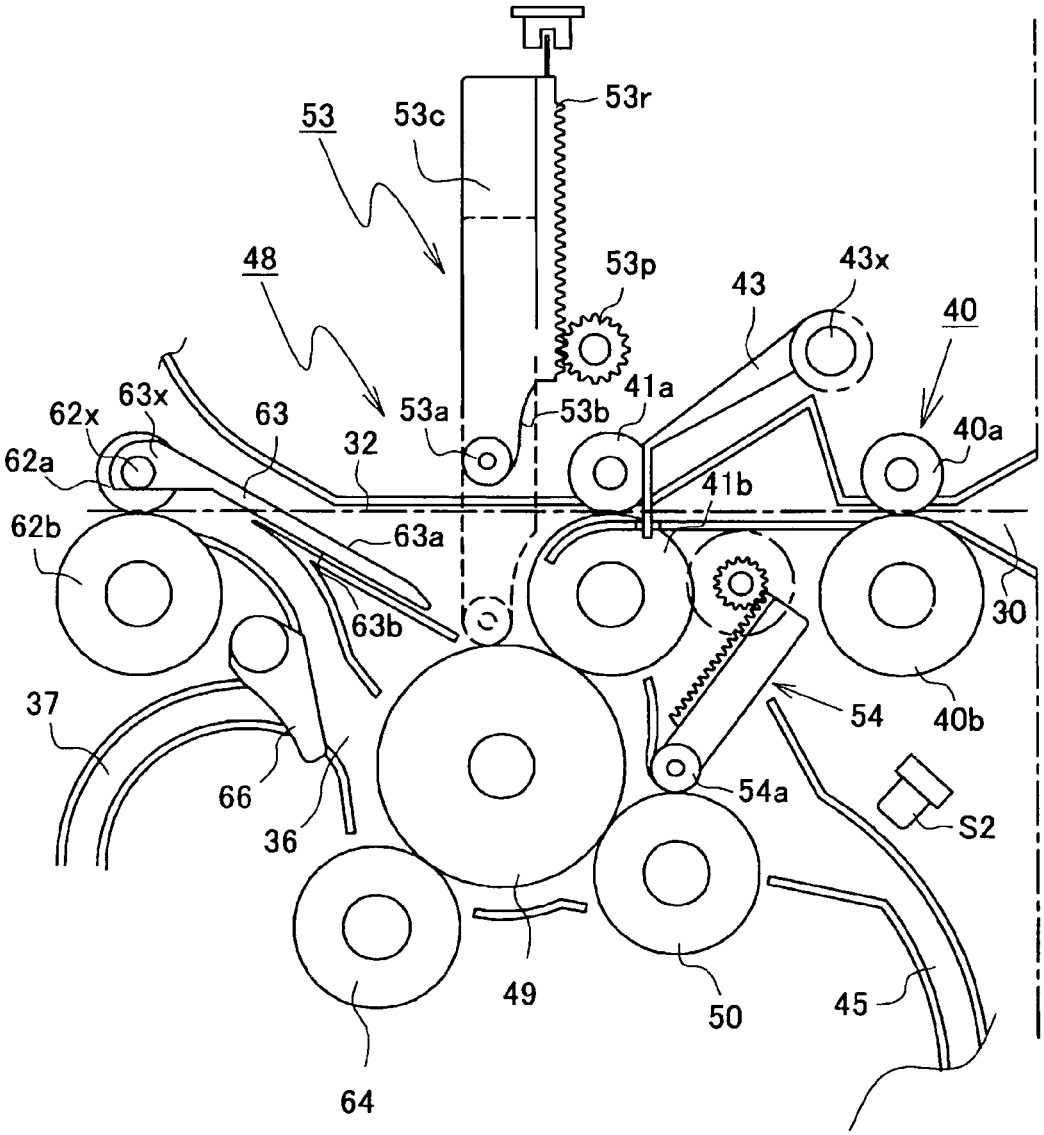
FIG. 4 is an enlarged explanatory view of principal part in the sheet folding apparatus of FIG. 3.
Figure 5:
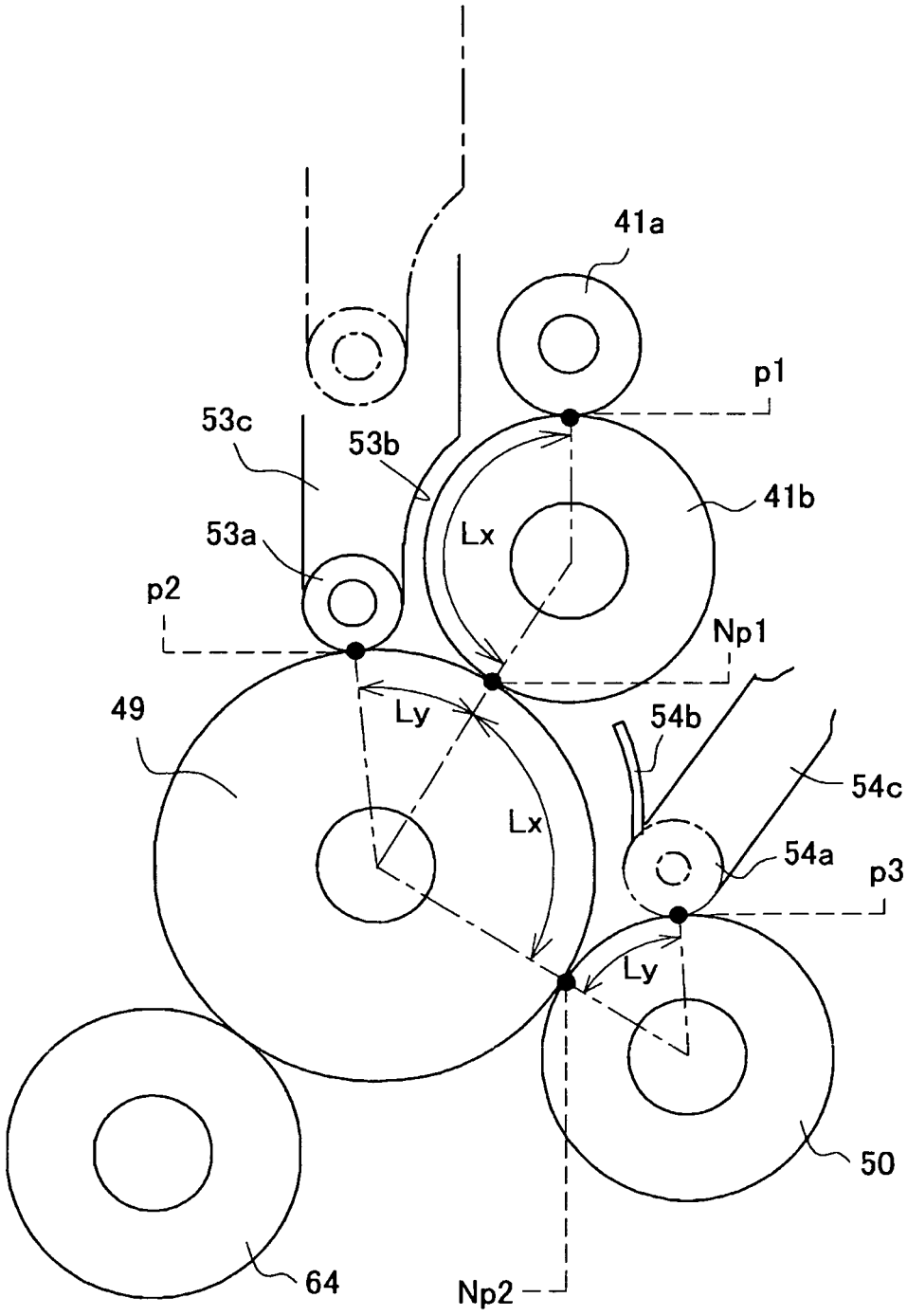
FIG. 5 is an explanatory view of a layout configuration of folding rolls of FIG. 3.

In the folding rolls comprised of three rolls (41*b*, 49, 50) as described above, the first folding deflecting member 53 is disposed in the first nip portion Np1, the second folding deflecting member 54 is disposed in the second nip portion Np2, and each member guides a fold of the sheet to the respective nip portion (press-contact point). In the apparatus as shown in FIG. 3, the first folding deflecting member 53 and the second folding deflecting member 54 have the same structure, and the structure of the first folding deflecting member 53 will be described. As shown in FIGS. 4 and 5, the folding deflecting member 53 is comprised of a driven roller 53*a*, guide member 53*b* and up-and-down member 53*c*.

As shown in FIG. 5, the first nip portion Np1 for first folding the sheet is comprised of the first roll 41*b* and second roll 49, the first roll 41*b* is disposed on the upstream side, and the second roll 49 is disposed on the downstream side. Thus, the driven roll 53*a* is disposed in a position coming into contact with the periphery of the second roll 49. Then, the guide member 53*b* is provided with a curved guide surface along the first roll 41*b* positioned on the upstream side.

The driven roller 53*a* and the guide member 53*b* are supported by the up-and-down member 53*c*. The up-and-down member 53*c* is comprised of a bracket member (frame member) of an appropriate shape, the driven roller 53*a* is supported rotatably by the up-and-down member 53*c*, and concurrently, the guide member 53*b* is fixed to the member 53*c*. Then, the up-and-down member 53*c* is supported by a guide rail provided in the apparatus frame, and is configured to move up and down between an operating position (dashed-line position in FIG. 4) in which the driven roller 53*a* comes into contact with the periphery of the second roll 49, and a waiting position (solid-line position in FIG. 4) in which the driven roller 53*a* retracts out of the second path 33. The up-and-down member 53*c* is coupled to shift means 56 described later, and shifts positions of the driven roller 53*a* and guide member 53*b* between the operating position and the waiting position.

Then, the above-mentioned driven rollers 53*a*, 54*a* and the guide members 53*b*, 54*b* are set for the position relationship as shown in FIG. 5. In the nip portion Np1, the sheet is fed from the carry-in entrance 30 by the first roll 41*b* and the pinch roller 41*a* coming into press-contact with the roll 41*b*. The press-contact point of the pinch roller 41*a* is shown by p1 in FIG. 5.

The above-mentioned driven roller 53*a* comes into press-contact with the second roll 49 positioned on the downstream side, and the press-contact point is shown by p2 in FIG. 5. Then, when a fold position of the sheet is guided to the first nip portion Np1, the upstream side of the sheet is provided with transport force in the press-contact point p1, and is guided to the first nip portion Np1 along the periphery of the first roll 41*b*. Further, the downstream side of the sheet is provided with transport force in the press-contact point p2, and is guided to the first nip portion Np1 along the periphery of the second roll 49.

At this point, the transport length Lx between the press-contact point p1 and the first nip portion Np1 and the transport length Ly between the press-contact point p2 and the first nip portion Np1 are set at Lx>Ly. The position of the driven roller 53*a* is set in such a transport length relationship. Then, the guide member 53*b* described previously forms the curved guide surface in the shape of a curve along the periphery of the first roll 41*b* with the longer transport length.

In other words, conventionally, the blade member for guiding a fold to the nip portion (Np1, Np2) has been provided separately from the sheet feeding means, and has becomes a cause of displacement or wrinkle occurring in the fold by timing deviation acting on the sheet. To solve the problem, the apparatus as shown in the figure, the transport length Lx of the first roll 41*b* on the upstream side of the sheet fed to the first nip portion Np1 and the transport length Ly of the second roll 49 on the downstream side are set at [Lx>Ly], concurrently the curved guide surface of the guide member 53*b* is configured in the shape for bringing the sheet along the periphery of the first roll 41*b* with the longer transport length, and the driven roller 53*a* and the guide member 53*b* are concurrently shifted from the waiting position to the operating position.

By thus configuring, the fold of the sheet is correctly guided to the nip portion Np1 without using particular folding blade means. In addition, as can be seen from FIG. 5, to set the transport lengths at [Lx>Ly], it is necessary to make the roll diameter of the driven roll 53*a* smaller than the roll diameter of the first roll 41*b* positioned on the upstream side.

Similarly, the second folding deflecting member 54 provides the sheet with transport force in the first nip portion Np1 of the second roll 49 positioned on the upstream side, and [Lx>Ly] is set on the transport length Lx from the point of Np1 to the second nip portion Np2 and the transport length Ly between the press-contact point p3 of the driven roller 54*a* and the third roll 50 positioned on the downstream side and the second nip portion Np2.

Then, the curved guide surface of the guide member 54*b* is configured in the shape for bringing the sheet along the periphery of the second roll 49 with the longer transport length. In addition, the second folding deflecting member 54 and the previously-mentioned first folding deflecting member 53 move in the opposite manner such that one is in the operating position when the other one is positioned in the waiting position. This is because the same driving means lifts and lowers the up-and-down member 53*c* and the up-and-down member 54*c*.

[Driving Mechanism]

The driving mechanism for the first path 32, second path 33 and folding processing means 48 as described above will be described. As shown in FIG. 4, in the first path 32, the carry-in exit 30 is provided with a carry-in roller pair 40 (first transport means), the pinch roller 41*a* (second transport means) is disposed on the downstream side of the roller pair, and the carrying-out exit 31 is provided with a carrying-out roller pair 62.

The carry-in roller pair 40 is comprised of a pair of rollers 40*a*, 40*b*, and one of the rollers, 40*b*, is coupled to a transport motor Mf described later. Similarly, the carrying-out rollers 62 are comprised of a roller pair 62*a*, 62*b*, and one of the rollers, 62*b*, is coupled to the transport motor Mf. Further, the pinch roller 41*a* is disposed to rotate in accordance with the first roll 41*b*, and the roll 41*b* is coupled to the transport motor Mf.

In the above-mentioned second path 33, as shown in FIG. 3, the first switchback path 34 and second switchback path 35 forming the path 33 are not provided with the transport means such as a roller and belt for providing the sheet with transport force. Then, the first switchback path 34 is configured so that the first roll 41*b* and the pinch roller 41*a* coming into press-contact with the roll 41*b* provide the transport force in the carry-in direction for carrying the sheet into the path, and that the driven roller 53*a* coming into press-contact with the second roll 49 provides the transport force for carrying the sheet from the path to the first folding position Np1.

Meanwhile, the second switchback path 35 is configured so that the transport force for carrying the sheet into the path is provided in the nip portion of the first roll 41*b* and second roll 49, and that the transport force for feeding the sheet to the second folding position Np2 from the path is provided by the driven roller 54*a* of the second folding deflecting means 54. In the third path 36 continued from the second switchback path 35, as shown in FIG. 4, the roller 64 for enhancing folding coming into press-contact with the second roll 49 provides the transport force for carrying out the folded sheet toward the carrying-out roller 62. Accordingly, any transport means provided with a particular driving mechanism is not disposed in the third path 36.

Further, in the third path 36 is disposed the sheet discharge path 37 for guiding the three-folded sheet to the storage stacker 65 without carrying to the carrying-out exit 31, and a sheet discharge roller 67 is provided in the path 37.

Figure 13:
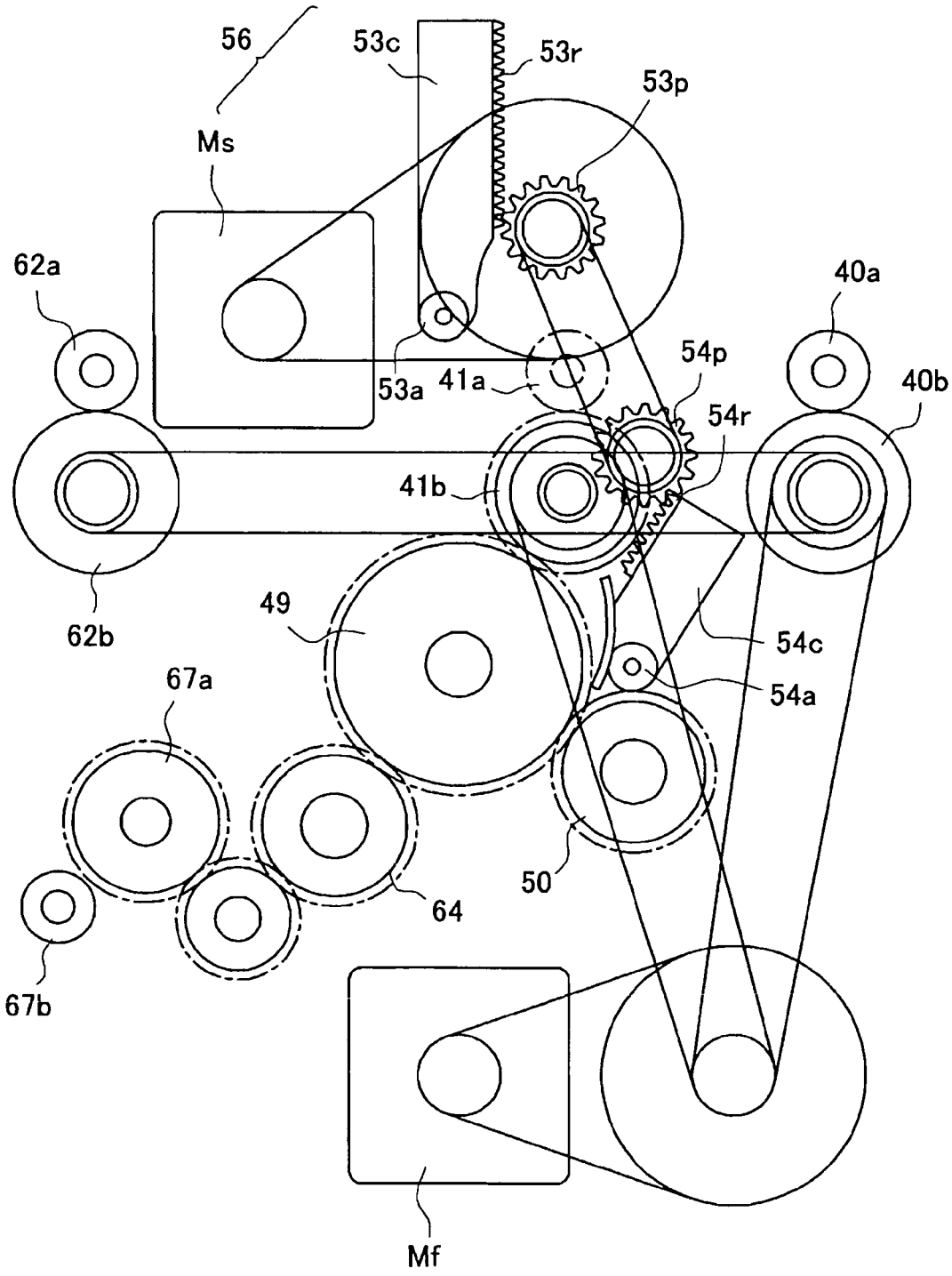
FIG. 13 is an explanatory view of a driving mechanism in the apparatus of FIG. 3.

Therefore, as shown in FIG. 13, driving of the transport motor Mf is conveyed to the carry-in roller pair 40 and carrying-out roller 62 of the first path 32, first roll 41*b*, second roll 49, and third roll 50 of the folding processing means 48 and the sheet discharge roller 67 of the sheet discharge path 37. In other words, driving of the transport motor Mf is conveyed to the first roll 41*b* by a belt, and is conveyed so that the first roll 41*b*, second roll 49 and third roll 50 have the same circumferential velocity by gears and the like.

Meanwhile, the up-and-down member 53*c* of the first folding deflecting member 53 and the up-and-down member 54*c* of the second folding deflecting member 54 are coupled to a shift motor Ms so as to shift to positions between the waiting position and the operating position in the opposite manner. The motor Ms is comprised of a forward/backward rotation motor, and pinions 53*p*, 54*p* mesh with racks 53*r*, 54*r* formed in the first up-and-down member 53*c* and the second up-and-down member 54*c*, respectively. Then, when the shift motor Ms rotates forward, the first up-and-down member 53*c* shifts from the waiting position to the operating position, and when the shift motor Ms rotates backward, the second up-and-down member 54*c* shifts from the waiting position to the operating position. Accordingly, the shift motor Ms, racks 53*r*, 54*r* and pinions 53*p*, 54*p* constitute shift means 56 (see FIG. 13) for moving the up-and-down members 53*c*, 54 up and down.

[Sheet Front End Detecting Sensor]

As described above, a first sensor S1 for detecting an end edge of a sheet is disposed in the first path 32, and detects the end edge (front end and rear end) of the sheet carried in the first switchback path 34. Further disposed is a second sensor S2 for detecting the end edge of the sheet carried in the second switchback path 35. The sensors S1 and S2 detect the end edge of the sheet to calculate the fold position of the sheet, and the action of the sensors will be described later together with the folding form.

[Register Mechanism]

Figure 6:
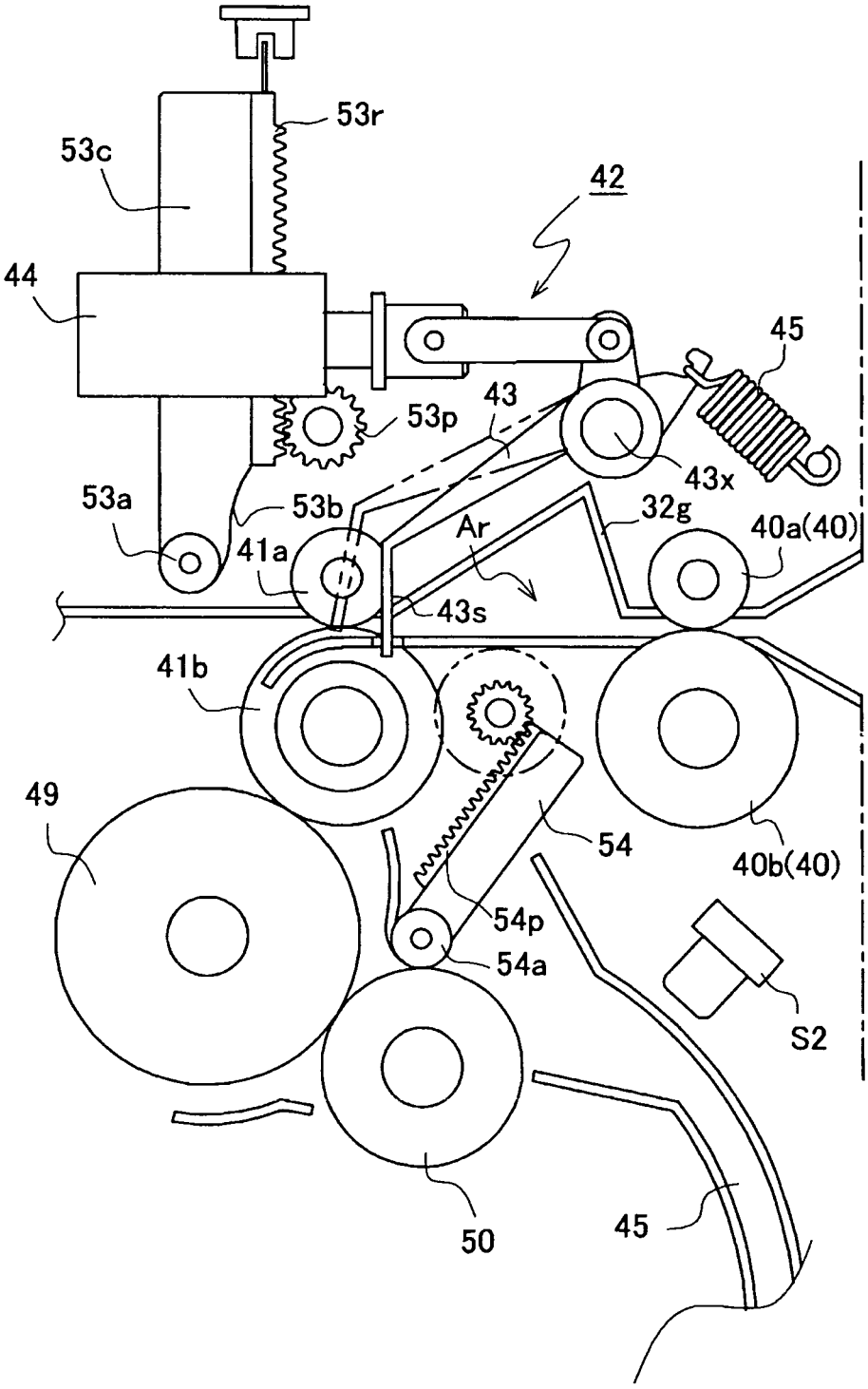
FIG. 6 is an explanatory view of a layout configuration of a register mechanism and second folding deflecting means in the sheet folding apparatus of FIG. 3.
Figure 7A:
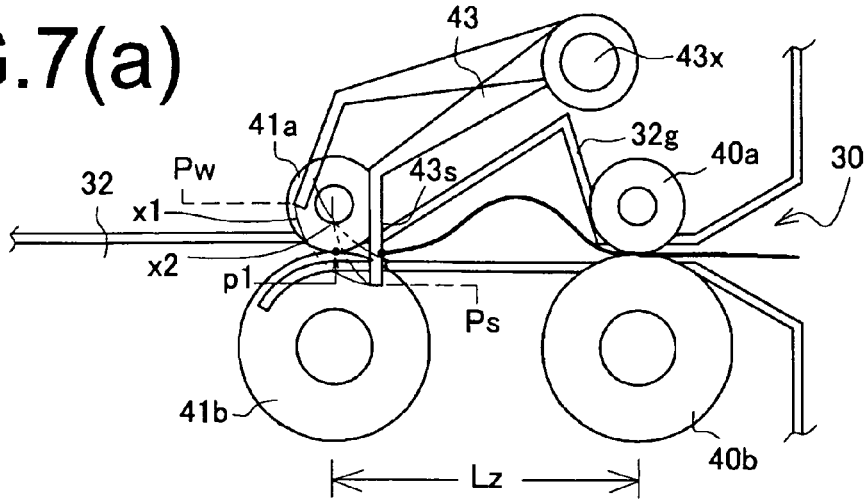
FIG. 7 contains explanatory views illustrating action of the register mechanism of FIG. 6, where FIG. 7(*a*) shows a state in which a gate stopper is in an operating position, FIG. 7(*b*) shows a state in which the gate stopper moves to a retracted position, and FIG. 7(*c*) shows a state in which the gate stopper is in the retracted position.
Figure 7B:
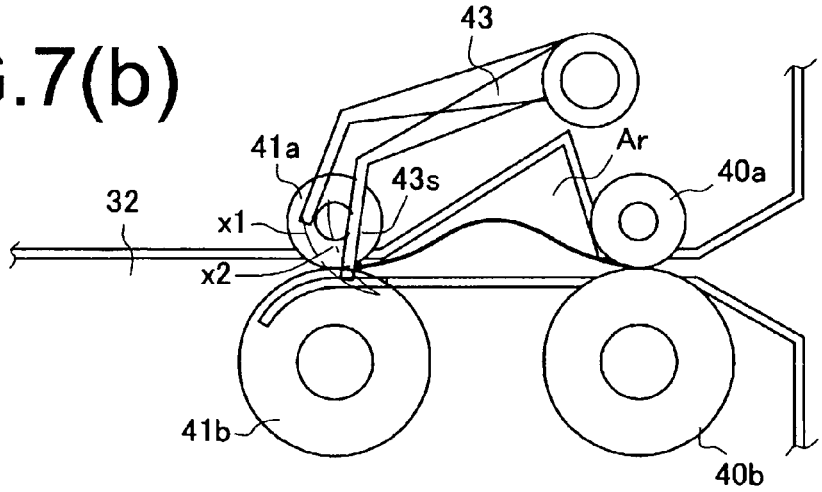
Figure 7C:
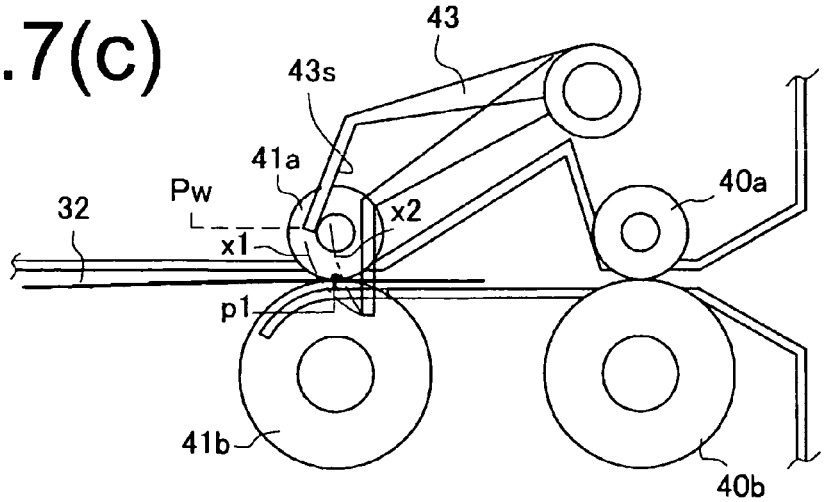

Meanwhile, in the first path 32, a register mechanism is disposed in between the carry-in roller pair 40*a*, 40*b* and the pinch roller 41*a*. As shown in FIGS. 6 and 7, as the register mechanism, the first transport means 40 comprised of the carry-in roller pair 40*a*, 40*b* and the second transport means 41 comprised of the pinch roller 41*a* and the first roll 41*b* are disposed a distance Lz apart from each other. In the interval Lz are formed gate stopper means 42 for locking the sheet front end and register area Ar (space) for curving and deforming the sheet. The pinch roller 41*a* is made of polyacetal (POM), and the first roll 41*b* is made of a rubber material.

The gate stopper means 42 is comprised of a stopper member 43 provided with a regulation surface 43*s* to strike the sheet front end to lock, and stopper driving means 44 for shifting the regulation surface 43*s* to positions between a lock position Ps inside the first path and a waiting position Pw outside the path.

The stopper member 43 shown in the figure is comprised of a lever member, axially supported at the base end portion by the apparatus frame so as to swing on the spindle 43*x*, and provided with the regulation surface 43*s* for locking the sheet front end moving in the first path 32 formed in the front end portion. Then, equipped are a biasing spring 45 for biasing the stopper member 43 toward the waiting position side and stopper driving means (operating solenoid in the apparatus shown in the FIG. 44 for shifting the stopper member to the lock position Ps against the spring. Further, the register area Ar is comprised of space for deforming the sheet in the shape of a loop by curving a sheet guide plate 32*g* constituting the first path 32 as shown in FIG. 6.

Then, as shown in FIG. 7(*a*), the regulation surface 43*s* axially supported to be able to swing on the spindle 43*x* is configured so that the trajectory of the lock point of the sheet shifting from the operating position (lock position; solid line in FIG. 7(*a*)) Ps to the waiting position (dashed line in FIG. 7(*a*)) Pw passes through the press-contact point p1 of the second transport means 41 or passes through the vicinity of the point p1.

Accordingly, the regulation surface 43*s* locks the sheet front end in the operating position (lock position) Ps, and in shifting from this state to the waiting position Pw, shifts according to the trajectory for guiding the sheet front end to the press-contact point p1. Concurrently therewith, the roller diameter of the first roll 41*b* is set to be larger than the roller diameter of the pinch roller 41*a*. Then, the roller 41*b* with the large diameter is disposed below in the gravity action direction, and the regulation surface 43*s* is disposed above in the gravity action direction. Accordingly, the regulation surface 43*s* guides the sheet front end to the press-contact point p1 in between the surface 43*a* and the periphery of the roller (first roll 41*b*) with the large diameter.

Herein, the action of the gate stopper means 42 is described. The regulation surface 43*s* is set for the attitude substantially orthogonal to the first path 32 in the operating position (lock position) Ps as shown in FIG. 7, and when the surface 43*s* shifts from this position to the waiting position Pw, the sheet front end is guided to the press-contact point p1 in between the regulation surface 43*s* and the large-diameter roller periphery, and does not strike the periphery of the small-diameter roller (pinch roller 41*a*) by the regulation surface 43*s* blocking. Accordingly, when the sheet is guided to the press-contact point p1 of a pair of rollers 41*a*, 41*b*, the sheet front end is guided by either the regulation surface 43*s* or the large-diameter roller 41*b*, and is thereby guided to the press-contact point p1 in a relatively stable state.

In other words, the regulation surface 43*s* of the stopper member 43 locks the sheet front end in the attitude substantially orthogonal to the first path 32 in the operating position (lock position) Ps of FIG. 7(*a*). Therefore, the sheet fed to the first transport means 40 on the upstream side is locked at the front end by the regulation surface 43*s*, and is curved in the shape of a loop as shown in the figure. At this point, the skew of the sheet is corrected.

Then, as shown in FIG. 7(*b*), when the regulation surface 43*s* shifts to the waiting position side, the surface 43*s* shifts in the trajectory in the dashed-line x1-X2 direction shown in FIG. 7(*b*) so that the trajectory passes through the press-contact point p1 of the second transport means 41 or passes through the vicinity of the point. Then, the sheet locked by the regulation surface 43*s* shifts while following the regulation surface. Accordingly, the sheet front end is guided to the press-contact point p1 while maintaining the attitude such that the skew is corrected in the lock position Ps.

Then, the regulation surface 43*s* waits in the waiting position Pw as shown in FIG. 7(*c*) after guiding the sheet front end to the press-contact point P1. In addition, for the shift of the stopper member 43 from the operating position (lock position) Ps to the waiting position Pw, the current to the operating solenoid (stopper driving means) 44 is switched off, and the stopper member 43 is returned to the waiting position Pw by the biasing spring 45.

[Embodiment 2 of the Folding Processing Means]

The above-mentioned folding processing means 48 described based on FIGS. 3 to 7 shows the case where the first folding deflecting means 53 and the second folding deflecting means 54 are comprised of the driven rollers 53*a*, 54*a*, guide members 53*b*, 54*b*, and the up-and-down members 53*c*, 54*c* mounted with the driven roller and guide member, and the up-and-down members are coupled to the shift motor Ms using the racks 53*r*, 54*r* and the pinions 53*p*, 54*p*. The folding processing mechanism can be configured as shown in FIG. 14.

Figure 14A:
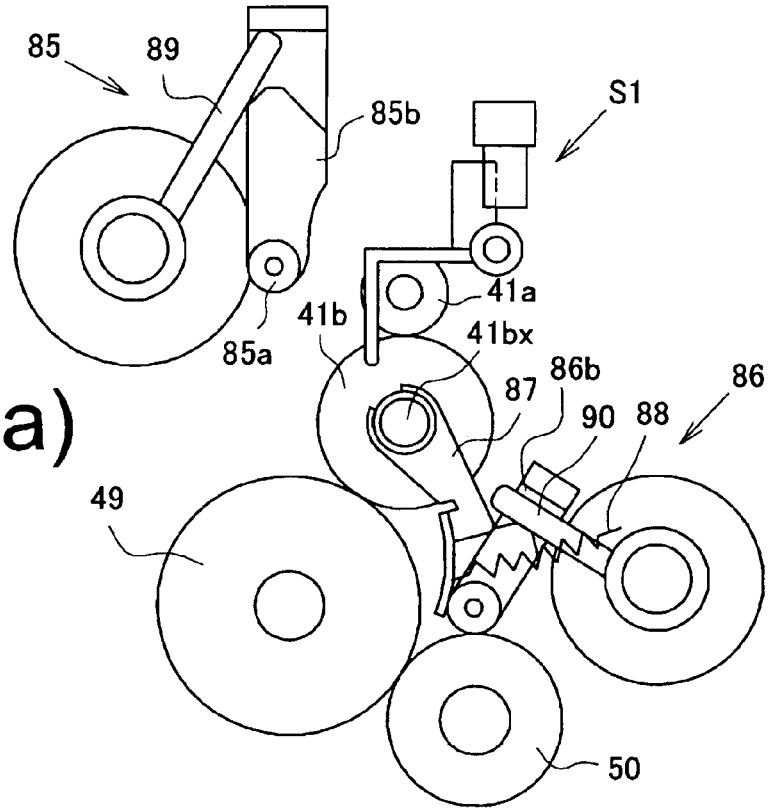
FIG. 14 is an explanatory view of an Embodiment different from the folding deflecting member of FIG. 3.
Figure 14B:
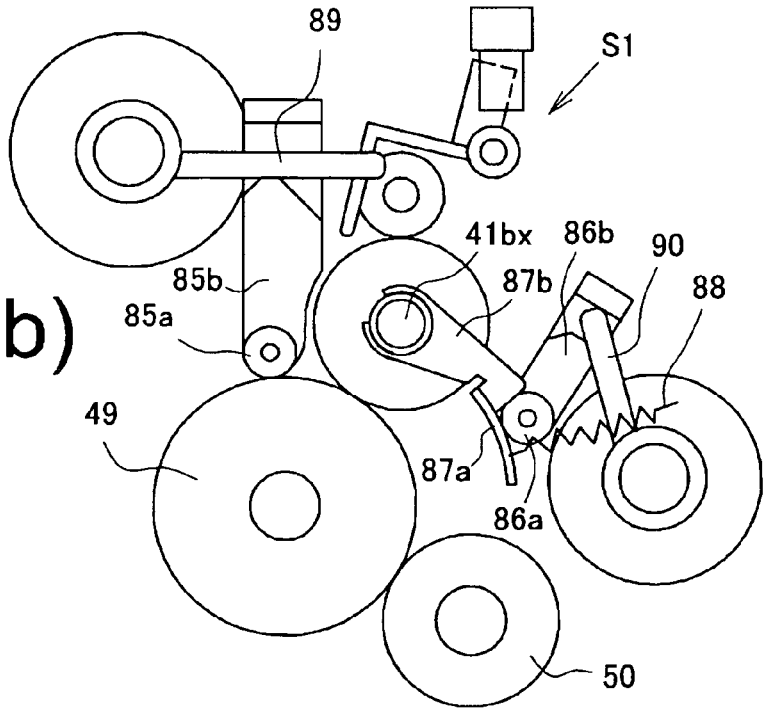

In the Embodiment as shown in FIG. 14, a second folding deflecting member 86 is configured so that a driven roller 86*a* and a guide member 87 are separately mounted on the apparatus frame, and the guide member 87 moves up and down between the waiting position and the operating position in conjunction with the up-and-down operation of the driven roller 86*a*.

The second folding deflecting means 86 shown in FIG. 14 is comprised of an up-and-down member 86*b*, the driven roller 86*a* mounted on the member 86*b*, and the guide member 87 disposed separately from the up-and-down member 86*b*. As in the Embodiment described previously, the up-and-down member 86*b* is supported by the guide rail (not shown in the figure) of the apparatus frame to be able to reciprocate. Then, the driven roller 86*a* is supported rotatably by the up-and-down member 86*b*.

Meanwhile, in the guide member 87, a bracket 87*b* is axially supported swingably by a driving shaft 41*bx* of the first roll 41*b*, and is provided at the front end with a curved guide surface 87*a* along the periphery of the second roll 49. Then, the guide member 87 is provided with a return spring 88 for biasing the curved guide surface 87*a* to the waiting position side retracted from the second switchback path 35 about the spindle of the bracket 87*b*.

Then, the guide member 87 is engaged so that the curved guide surface 87*a* shifts to positions from the waiting position to the operating position in conjunction with the shift of the driven roller 86*a* from the waiting position to the operating position. Accordingly, thus configured second folding deflecting means 86 reciprocates between the waiting position and the operating position as in the previously mentioned member.

Further, in the apparatus of FIG. 14, a driving mechanism is configured to drive using lifting/lowering levers 89, 90 when the up-and-down member 85*b* of the first folding deflecting means 85 and the up-and-down member 86*b* of the second folding deflecting means 86 are shifted in position from the waiting position to the operating position. In other words, the lifting/lowering lever 89 for first folding and the lifting/lowering lever 90 for second folding are supported at their base end portions to swing on rotary shafts, and the rotary shafts are coupled to the shift motor Ms, not shown.

Then, the front end portions of the lifting/lowering levers 89, 90 are disposed to engage in the up-and-down members 85*b*, 86*b*. In addition, biasing springs, not shown, are disposed in the up-and-down member 85*b*, 86*b*, and always bias the driven rollers 85*a*, 86*a* to the operating position side.

Further, in the apparatus of FIG. 14, the first sensor S1 disposed in the first path 32 is comprised of a lever sensor as shown in the figure. The other configuration is the same as that of the apparatus in FIGS. 3 to 7, and the same reference numerals are assigned to omit descriptions thereof.

[Folding Professing Form]

Figure 12A:
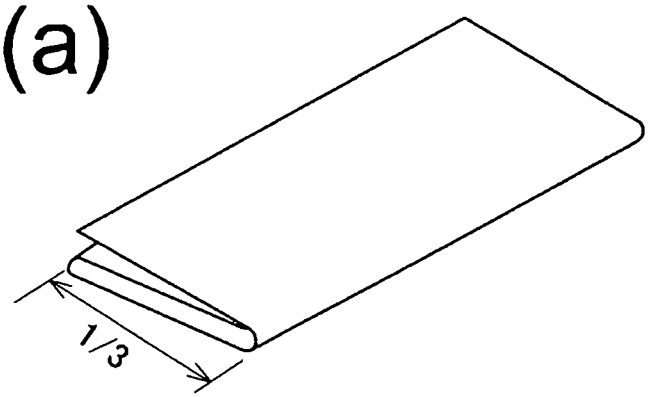
FIG. 12 contains explanatory views of sheet folding forms in the sheet folding apparatus of the invention, where FIG. 12(*a*) shows an aspect for performing inward three-folding on the sheet in a ⅓ position, FIG. 12(*b*) shows an aspect for performing Z-folding on the sheet in a ⅓ position, and FIG. 12(*c*) shows an aspect for performing Z-folding in a ¼ position.
Figure 12B:
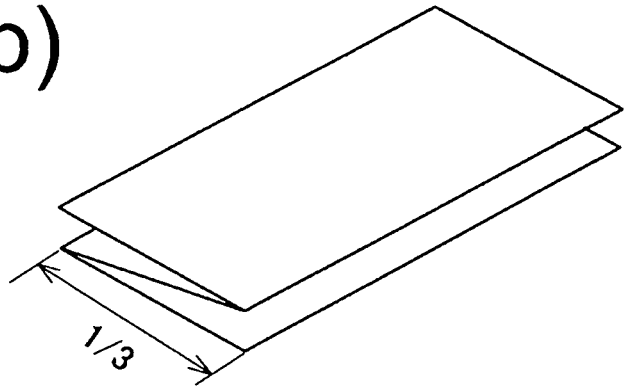
Figure 12C:
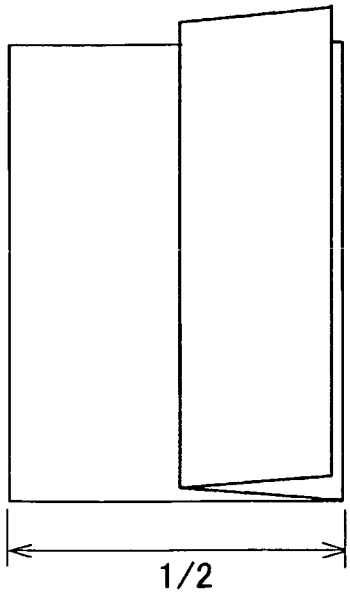

A sheet folding method by the above-mentioned folding processing means 48 will be described next according to FIG. 12. In a normal sheet with the image formed, there are cases that the sheet is folded in two or three with a binding margin left for a filing finish, and that the sheet is folded in two or three for a letter finish. Further, in folding in three, there are cases of z-folding and inward three-folding. FIG. 12(*a*) shows inward three-folding, FIG. 12(*b*) shows ⅓Z-folding, and FIG. 12(*c*) shows ¼ Z-folding.

Then, in the case of two-folding, the sheet fed to the second path 33 is folded in a ½ position of the sheet size or in a ½ position with a binding margin left in the sheet end portion by the first and second rolls 41*b* 49 (first folding).

Meanwhile, in the case of three-folding, the sheet fed to the second path 33 is folded in a ⅓ position of the sheet size or in a ⅓ position with a binding margin left in the sheet end portion by the first and second rolls 41*b*, 49 (first folding). The second and third rolls 49, 50 fold the remaining sheet in a ⅓ position of the folded sheet (second folding) to feed to the third path 36.

Further, in the case of three-folding, when inward three-folding is performed as shown in FIG. 12(*a*), the sheet fed to the second path 33 is folded in a ⅓ position on the sheet rear end side by the first and second rolls 41*b*, 49 and next, is folded in a ⅓ position on the sheet front end side. Similarly, in the case of ⅓ Z-folding, the sheet fed to the second path 33 is folded in a ⅓ position on the sheet front end side by the first and second rolls 41*b*, 49 and next, is folded in a ⅓ position on the sheet rear end side.

Furthermore, in the case of three-folding, when z-folding is made in a ¼ position as shown in FIG. 12(*c*), the sheet fed to the second path 33 is folded in, a ¼ position on the sheet rear end side by the first and second rolls 41*b*, 49 and next, is folded in a ½ position of the sheet.

[Control Means]

The control means for above-mentioned sheet folding is configured as described below. The sheet folding apparatus B as described previously is mounted with a control CPU, or a control section of the image formation apparatus A is provided with a folding processing control section. Then, the control section is configured to enable the following operation.

First, the first switchback path 34 and second switchback path 35 of the second path 33 are provided with stopper means (not shown) for regulating the position of the sheet front end or sensor means (S1 and S2 shown in the figure) for detecting the position of the sheet front end. In the apparatus as shown in the figure, the sheet sensor S1 is disposed in the first switchback path 34, and the sheet sensor S2 is disposed in the second switchback path 35. Then, the control means 95 is configured to calculate timing at which the fold position of the sheet arrives at a predetermined position from the sheet size information sent from the image formation apparatus A and a detection signal from the sensor S1 (S2).

Figure 15:
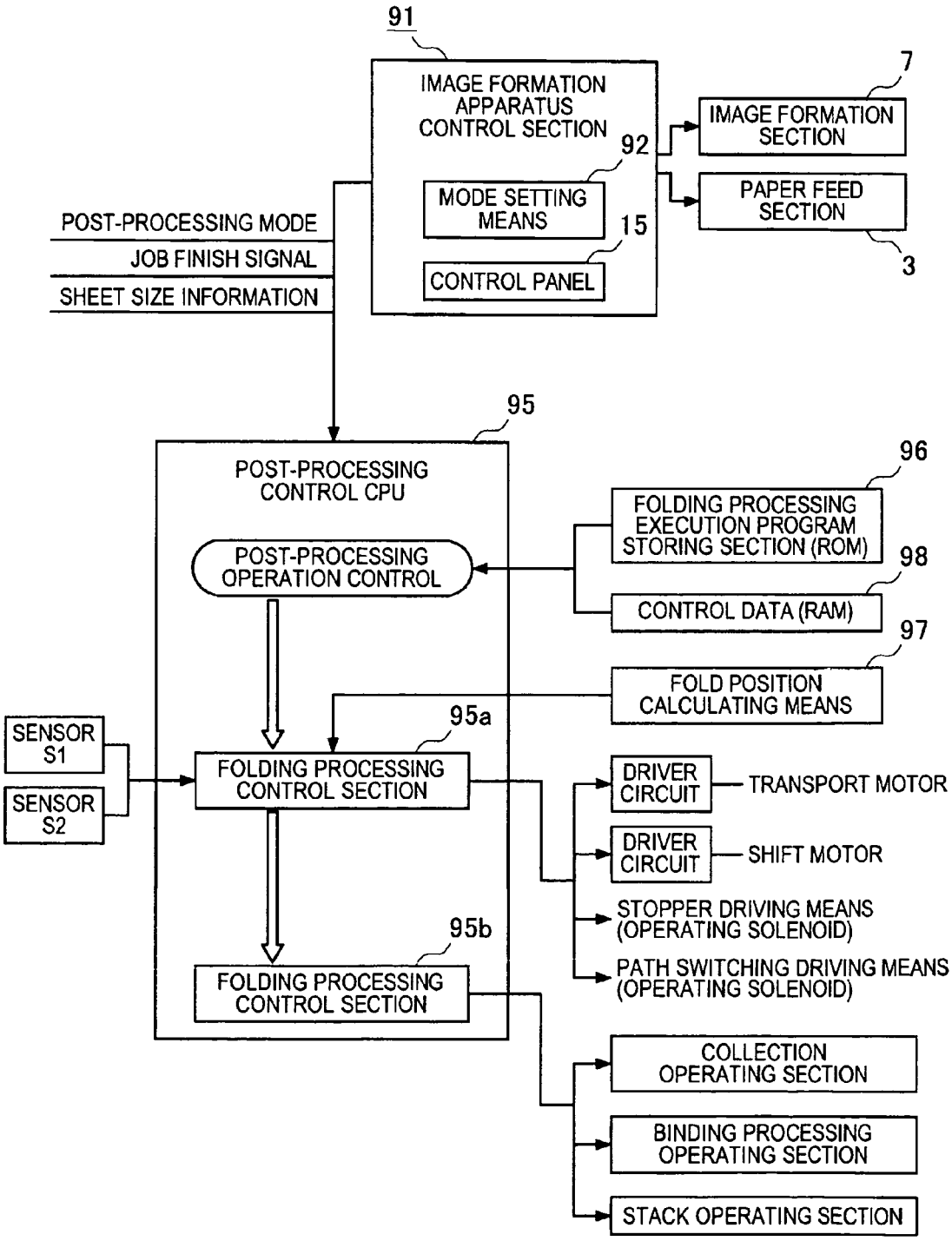
FIG. 15 is an explanatory view of a control configuration in the system of FIG. 1.

Then, the operation will be described according to the control block diagram shown in FIG. 15. The image formation apparatus A is provided with a control CPU 91, control panel 15 and mode setting means 92. The control CPU 91 controls a paper feed section 3 and image formation section 7, corresponding to image formation conditions set in the control panel 15. Then, the control CPU 91 transfers data and commands such as "post-processing mode", "job finish signal" and "sheet size information" required for post-processing to the control section 95 of the post-processing apparatus C.

The control section 95 of the post-processing apparatus C is a control CPU, and is provided with a "folding processing control section 95*a*" and "post-finish processing control section 95*b*". The folding processing control section 95*a* is comprised of fold position calculating means 97, a driver circuit for the transport motor Mf and a driver circuit for the shift motor Ms. Then, detection signals of the first sensor S1 and second sensor S2 are conveyed to the control CPU 95. Meanwhile, the control CPU 95 conveys "ON"/"OFF" control signals to the stopper driving means 44 provided in the gate stopper means 42 and the path switching means 63.

Then, for the control CPU 95, folding processing execution programs are stored in ROM 96 to control the transport motor Mf, shift motor Ms, stopper driving means 44 and path switching means 63 so as to execute the folding forms as described previously. Further, RAM 98 stores data to calculate the fold of the sheet in the fold position calculating means 97, and operation timing time of the shift motor Ms as data.

The fold position calculating means 97 is comprised of a computing circuit for calculating a fold position (dimension) from the sheet front end (front end in the sheet discharge direction), from the "sheet length size", "folding form" and "binding margin dimension". For example, in the two-folding mode, the sheet is folded in a ½ position in the sheet discharge direction, or a ½ position with a beforehand set binding margin left. For example, calculation of the fold position is obtained by calculating [{(sheet length size)−(binding margin)}/2].

Further, in the three-folding mode, for example, the fold position is calculated corresponding to the folding form such as letter folding (inward three-folding, ⅓ Z-folding) and filing folding (¼ Z-folding, ⅓ Z-folding).

[Folding Processing Operation]

Figure 8A:
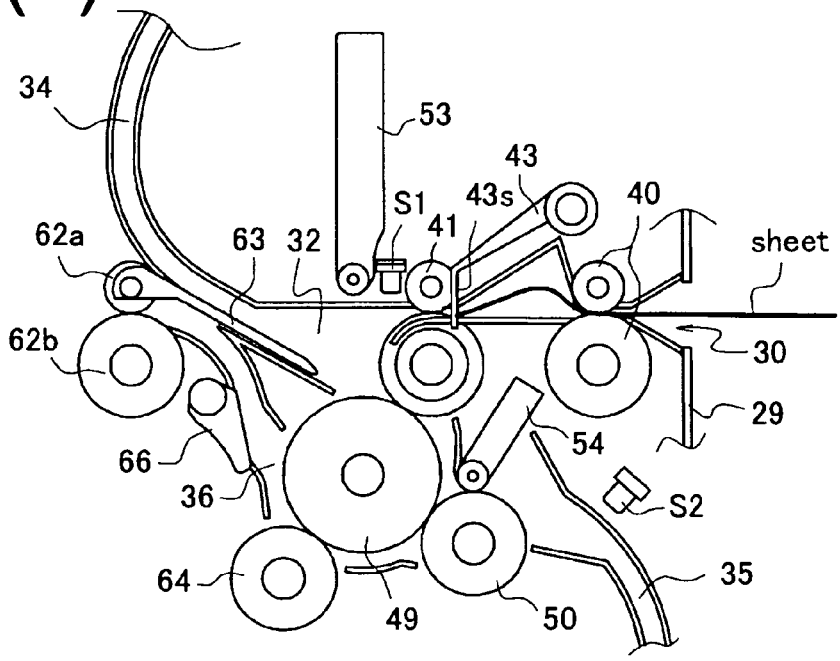
FIG. 8 contains state explanatory views of sheet folding operation in the apparatus of FIG. 3, where FIG. 8(*a*) shows a state in which a sheet undergoes register correction, and FIG. 8(*b*) shows a state in which the sheet is carried in a first switchback path.
Figure 8B:
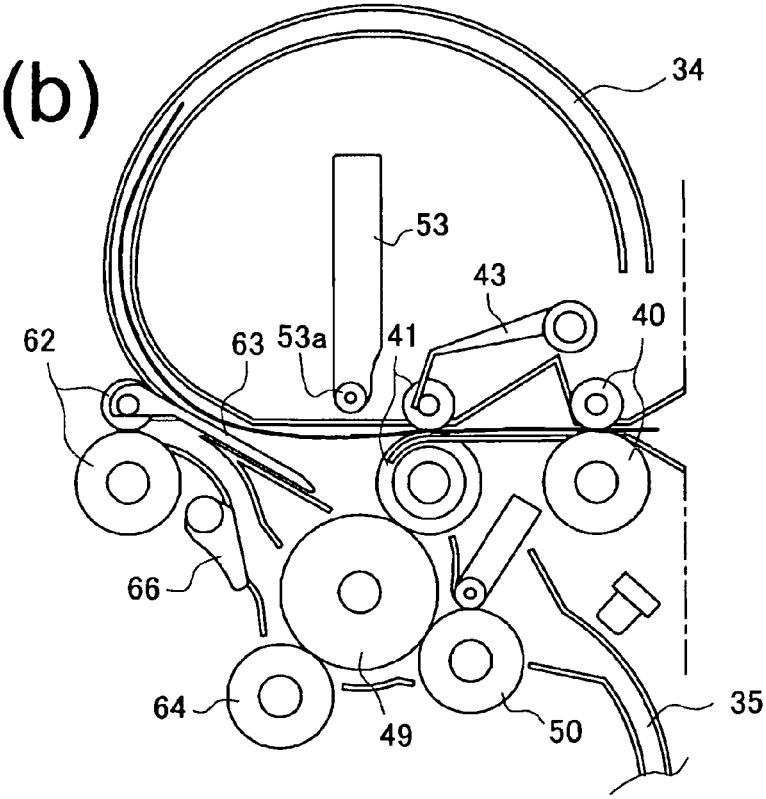
Figure 9A:
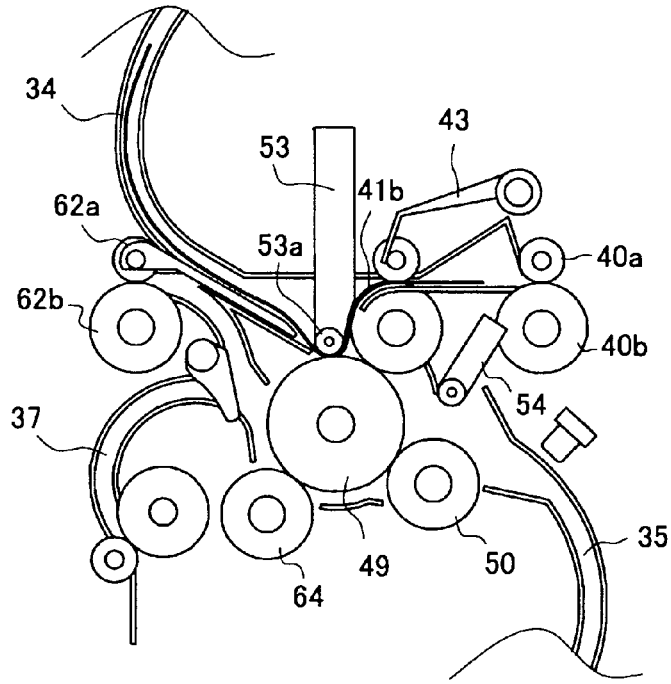
FIG. 9 contains state explanatory views of the sheet folding operation in the apparatus of FIG. 3, where FIG. 9(*a*) shows a state in which the sheet is first folded in a first nip portion, and FIG. 9(*b*) shows a state in which the first-folded sheet is carried in a second switchback path.
Figure 9B:
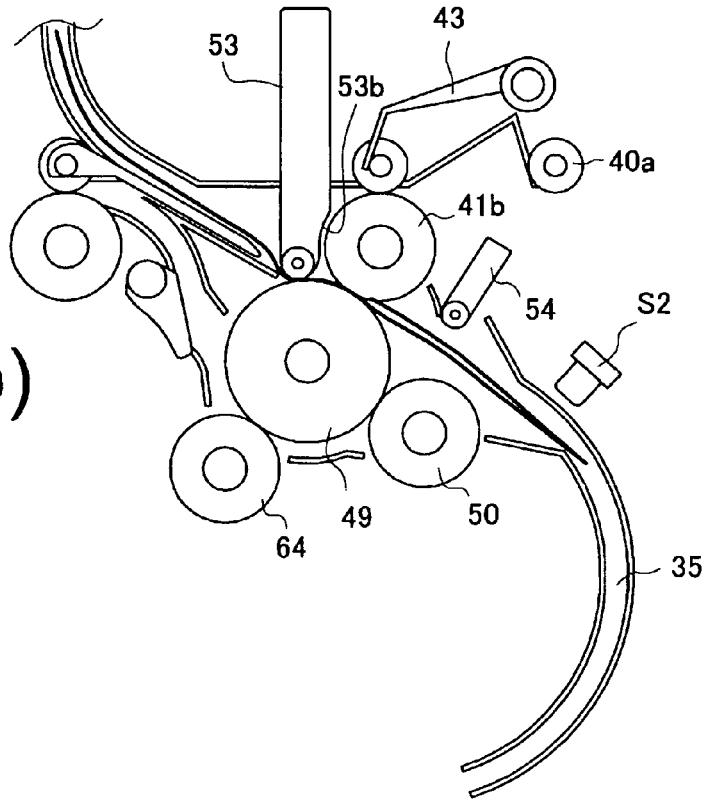

The action in the configuration of the sheet folding apparatus B will be described. FIG. 8(*a*) shows a state in which a sheet entering the carry-in entrance 30 undergoes register correction, and FIG. 8(*b*) shows a state in which the sheet is carried in the first switchback path 34 for first folding. FIG. 9(*a*) shows a state in which the sheet is folded in the first nip position Np1, FIG. 9(*b*) shows a state in which the folded sheet is carried in the second switchback path 35, FIG. 10(*a*) shows a state in which the sheet is folded in the second nip position Np2, and FIG. 10(*b*) is a state in which the folded sheet is carried out. Further, FIG. 11(*a*) is an operating state view illustrating folding operation in the two-folding mode, and FIG. 11(*b*) is a flow diagram of the control operation.

In FIG. 8(*a*), a sheet is guided to the carry-in entrance 30, and fed to the downstream side by the carry-in roller pair (first transport means) 40. At this point, the control means 95*a* controls the stopper driving means 44 so that the gate stopper means 42 is positioned in the operating position (lock position) Ps. Then, the sheet front end is locked by the regulation surface 43*s* of the stopper member 43, and the sheet is curved and deformed in the shape of a loop inside the register area, and at this point, aligned in the front end according to the regulation surface 43*s*.

Next, the control means 95*a* retracts the gate stopper means 42 from the operating position (lock position) Ps to the waiting position Pw. By the retracted operation of the gate stopper means 42, the shift trajectory of the regulation surface 43*s* retracting outside the path from the lock position Ps is set to pass through the vicinity of the press-contact point p1 of the second transport means 41 on the downstream side. Accordingly, the sheet front end is aligned by the regulation surface 43*s* in the lock position (operating position) Ps, and following the retracted operation of the regulation surface 43*s*, the sheet is guided to the press-contact point p1 while maintaining the attitude with the front end aligned.

In FIG. 8(*b*), the control means 95*a* shifts the gate stopper means 42 from the operating position (lock position) Ps to the waiting position Pw. Then, the sheet is fed to the downstream side in the first path 32 by the second transport means 41 rotating concurrently with rotation of the first transport means 40. Then, the control means 95*a* controls the path switching means 63 so as to guide the sheet to the first switchback path 34 from the first path 32 as shown in FIG. 8(*b*).

Thus, the sheet is carried in the first switchback path 34 by the second transport means 41. In addition, in the first path 32, the sheet sensor S1 is disposed on the downstream side of the second transport means 41, and detects the sheet front end carried in the first switchback path 34.

In FIG. 9(*a*), based on a signal such that the first sheet sensor S1 detects the sheet front end, the control means 95*a* shifts the up-and-down member 53*c* of the first folding deflecting member 53 at timing at which the fold position of the sheet is shifted to a predetermined position. Thus, the sheet in the first path 32 is deformed in the shape of a V toward the first nip portion Np1. Then, when the driven roller 53*a* attached to the up-and-down member 53*c* comes into press-contact with the periphery of the second roll 49, the sheet front end side is fed in the opposite direction (rotation direction of the second roll).

Meanwhile, the sheet rear end side feeds the sheet toward the first nip portion Np1 by transport force of the second transport means 41. At this point, the curved guide surface of the guide member 53*b* regulates the sheet to follow the roll periphery of the first roll 41*b*.

Accordingly, the sheet is fed toward the first nip portion (first folding position) Np1 on the front end side by the driven roller 53*a* and on the rear end side by the second transport means 41, and up-and-down timing of the up-and-down member 53*c* is to calculate the fold position. Therefore, the control means 95*a* beforehand sets the velocity for shifting the sheet by the second transport means 41 and the timing (particularly, timing at which the roller 53*c* comes into contact with the periphery of the second roll 49) for shifting the driven roller 53*a* to the operating position from the waiting position at optimal values by experiments.

Then, the curved guide surface of the guide member 53*b* guides the sheet to follow the periphery of the opposed first roll 41*b* in synchronization with the shift of the driven roller 53*a* from the waiting position to the operating position, and therefore, there is no fear that the fold position of the sheet changes every time.

In FIG. 9(*a*), the sheet folded in the ½ position (two-folding), ⅓ position (three-folding) or ¼ position (three-folding) in the first nip portion Np1 is provided with transport force by the first nip portion Np1 and fed to the downstream side. Then, the control means 95*a* positions the up-and-down member 54*c* of the second folding deflecting member 54 in the operating position in the two-folding mode, or in the waiting position in the three-folding mode. FIG. 9(*b*) shows control of the three-folding mode. In two-folding, the up-and-down member 54*c* is positioned in the operating position, and the folded sheet is guided to the second nip portion Np2 beginning with the front end, and is fed to the carrying-out exit 31 on the downstream.

Then, in the three-folding mode, the control means 95*a* positions the up-and-down member 54*c* of the second folding deflecting means 54 in the waiting position as shown in FIG. 9(*b*). Thus, the sheet fed from the first nip portion Np1 is fed to the second switchback path 35 beginning with the front end. Then, the sheet sensor S2 detects the sheet front end (fold position).

Figure 10A:
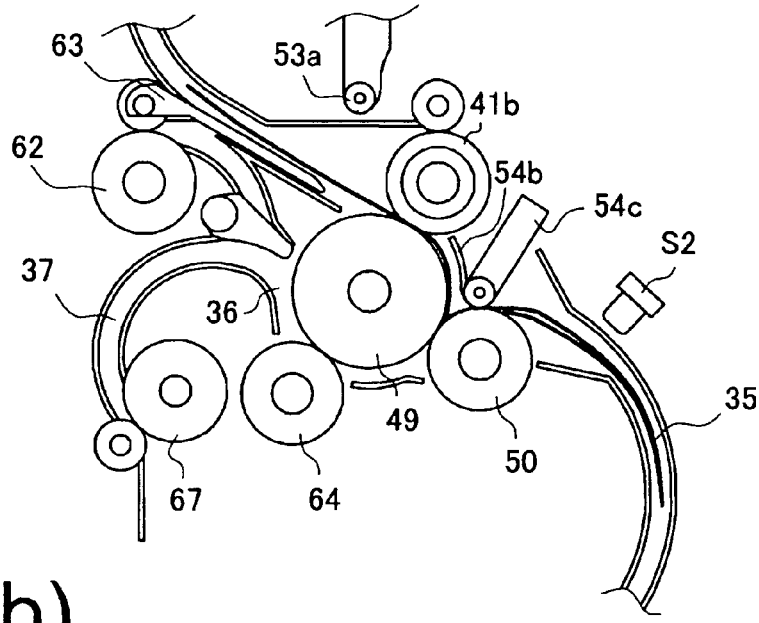
FIG. 10 contains state explanatory views of the sheet folding operation in the apparatus of FIG. 3, where FIG. 10(*a*) shows a state in which the sheet from the second switchback path is folded in a second nip portion, and FIG. 10(*b*) is a state in which the sheet folded in the second nip portion is carried out in the sheet discharge direction.
Figure 10B:
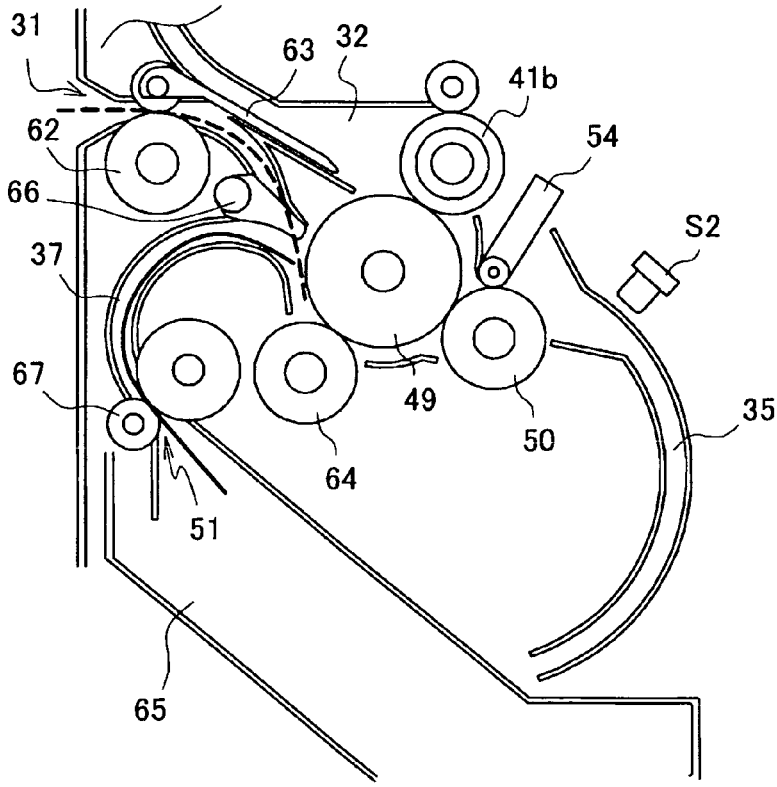

In FIG. 10(*a*), with reference to a detection signal of the sheet sensor S2, in a stage in which the fold position for second folding arrives at a predetermined position, the control means 95*a* shifts the up-and-down member 54*c* of the second folding deflecting member 54 from the waiting position to the operating position. Then, the sheet inside the second switchback path 35 is fed in the opposite direction in a stage in which the driven roller 54*c* comes into contact with the periphery of the third roll 50.

By this means, the sheet is guided to the second nip portion Np2 by the front end side sending the sheet by the driven roller 54*a* and the rear end side sending the sheet by the first nip portion Np1 in respective opposite directions. In addition, in this case, the shift timing of the up-and-down member 54*c* from the waiting position to the operating position is the same as in the case of the first folding deflecting member 53 as described previously, and the action of the guide member 54*b* is also the same as in the case.

In FIG. 10(*b*), in the folded sheet fed to the second folding position (second nip portion) Np2, the fold is reliably folded by the folding enhance roller 64 coming into press-contact with the second roller 49, and the sheet is carried to the third path 36. Then, the control means 95*a* feeds the folded sheet to the sheet discharge path 37 or feeds the sheet back to the first path 32 corresponding to the beforehand set sorting form. In the apparatus as shown in the figure, in inward three-folding and ⅓ Z-folding of the letter folding form with no need of binding in the post-processing C, the control means 95*a* controls a path switching flapper 66 to guide the sheet from the sheet discharge path 37 to the storage stacker 65.

Further, in the two-folding mode and three-folding mode of ¼ Z-folding or the like for filing or with the need of the post-processing such as bookbinding processing, the sheet is carried to the first path 32 from the third path 36, and fed to the post-processing apparatus C from the carrying-out exit 31.

[Folding Operation in the Two-Folding Mode]

In the above-mentioned folding operation, in the mode for folding the sheet in two, as shown in FIG. 11(*b*), the control means 95*a* receives a mode instruction signal of whether or not to perform folding processing concurrently with a sheet discharge instruction signal from the image formation apparatus A. Next, the control means 95*a* calculates the fold position in the fold position calculating means 97 (St01). Then, in the two-folding mode (St02), the sensor S1 detects the sheet front end (St03). After a lapse of sheet feeding time corresponding to the sheet length calculated in the fold position calculating means 97 from the detection signal (St04), the control means 95*a* shifts the first folding deflecting member 53 from the waiting position to the operating position (St05). This shift is controlled by rotation of the shift motor Ms.

In the process during which the up-and-down member 53*c* of the first folding deflecting member 53 shifts to the operating position, as described in FIG. 9(*a*), the sheet in the first path 32 is distorted toward the first nip portion Np1 with reference to the fold position. Then, when the driven roller 53*a* of the first folding deflecting member 53 comes into contact with the periphery of the second roll 49, the sheet is drawn and inserted in the first nip portion Np1 beginning with the fold position.

At this point, in the two-folding mode, after a lapse of predicted time that the fold of the sheet is inserted in the first nip portion Np1 with reference to a detection signal from the sensor S1 (St06), the control means 95*a* shifts the second folding deflecting member 54 to the operating position (St07). The predicted time is set at time elapsed before the front end of the folded sheet arrives at the guide member 54*b* after the fold position of the sheet is inserted in the first nip portion Np1. Accordingly, the front end of the folded sheet is guided by the curved guide surface of the guide member 54*b* and is brought along the second roll periphery in the state as shown in FIG. 11(*a*).

Concurrently therewith, since the driven roller 54*a* positioned in the operating position rotates in the direction shown by the arrow in FIG. 11(*a*) according to rotation of the third roll 50, even when the front end of the folded sheet is curled in the direction departing from the second nip portion Np2, the sheet is reliably guided to the second nip portion Np2 by the rotation of the driven roller 54*a* and third roll 50.

Then, the control means 95*a* carries the folded sheet, which is fed from the second nip portion Np2 to the third path 36, to the first path 32 from the third path 36. Next, the control means 95*a* prepares for processing of a subsequent sheet in a state in which the second folding deflecting member 54 is positioned in the operating position (St08). In the apparatus as shown in the figure, in relation to the first folding deflecting member 53 positioned in the waiting position, the second folding deflecting member 54 shifting to positions in the opposite manner is positioned in the operating position, but it is also possible to configure so that the second folding deflecting member 54 shifts to the waiting position by a detection signal of a sheet discharge sensor S3 disposed in the third path 36.

[Folding Operation of the Three-Folding Mode]

In the mode for folding the sheet in three, as described in FIGS. 8 to 10, the control means 95*a* receives a mode instruction signal of whether or not to perform folding processing concurrently with a sheet discharge instruction signal from the image formation apparatus A. Next, the control means 95*a* calculates the fold position in the fold position calculating means 97 (St01). Then, in the three-folding mode (St09), the sensor S1 detects the sheet front end (St10).

After a lapse of sheet feeding time corresponding to the sheet length calculated in the fold position calculating means 97 from the detection signal (St11), the control means 95*a* shifts the first folding deflecting member 53 from the waiting position to the operating position (St12). This shift is controlled by rotation of the shift motor Ms.

In the process during which the up-and-down member 53*c* of the first folding deflecting member 53 shifts to the operating position, as described in FIG. 9(*a*), the sheet in the first path 32 is distorted toward the first nip portion Np1 with reference to the fold position. Then, when the driven roller 53*a* of the first folding deflecting member 53 comes into contact with the periphery of the second roll 49, the sheet is drawn and inserted in the first nip portion Np1 beginning with the fold position. At this point, in the three-folding mode, the control means 95*a* waits for the second sensor S2 to detect the sheet front end (St13).

After a lapse of predicted time that the second-folding fold position of the sheet arrives at a predetermined position with reference to a detection signal such that the second sensor S2 detects the sheet front end (St14), the control means 95*a* shifts the second folding deflecting member 54 to the operating position (St15). The predicted time is set at a calculation value of the fold position calculating means 97. Then, the sheet is given transport force from the driven roller 54*a* and is inserted in the second nip portion Np2. The sheet discharge sensor S3 detects the sheet front end, and the sheet is carried out to the first path 32 from the third path 36, or carried out to the storage stacker 65 from the sheet discharge path 37 corresponding to the folding form.

In addition, in the invention, when the post-processing mode without performing sheet folding processing is set in the mode setting means 92 described previously, the sheet carried in the first path 32 is naturally fed directly to the sheet carrying-out exit 31.

[Configuration of the Sheet Discharge Path]

The folded sheet that is folded in two or three as described above is fed to the third path 36 from the press-contact point of the second and third rolls 49, 50. Then, the sheet is further folded by the roller 64 in press-contact with the second roller 49, and guided to the third path 36. The third path 36 merges with the first path 32 as described previously. The sheet discharge path 37 branches off from the third path 36, provided via the path switching flapper 66, and guides the folded sheet to the storage stacker 65 disposed below the second path 33. The sheet discharge path has the curvature R3 and is configured as described previously. "67" shown in the figure denotes the sheet discharge roller disposed in the sheet discharge path 37.

Accordingly, the sheet with no need of carrying to the post-processing apparatus C e.g. the sheet folded in the letter form such as inward three-folding and ⅓ Z-folding is stored in the storage stacker 65 without being carried to the carrying-out exit 31.

Then, in the folded sheet fed to the third path 36, the sheet to feed to the post-processing apparatus C for post-processing is carried toward the carrying-out exit 31 by the carrying-out roller 62. In addition, in this case, determination whether or not to perform post-processing is configured to be made by setting the post-processing condition concurrently with the image formation conditions in the control panel. Then, it is configured that the sheet is carried out to the storage stacker 65 or carried to the post-processing apparatus C corresponding to the set finish condition.

[Image Formation Apparatus]

The image formation apparatus A is provided with the following configuration as shown in FIG. 1. In this apparatus, the paper feed section 3 feeds a sheet to the image formation section 7, the image formation section 7 prints in the sheet, and the sheet is carried out of the main-body sheet discharge outlet 18. The paper feed section 3 stores sheets of a plurality of sizes in paper cassettes 4*a*, 4*b*, and separates designated sheets on a sheet-by-sheet basis to feed to the image formation section 7. In the image formation section 7, for example, an electrostatic drum 8, and a printing head (laser emitting device) 9, developing device 10, transfer charger 11 and fuser 12 arranged around the drum 8 are disposed, the laser emitting device 9 forms an electrostatic latent image on the electrostatic drum 8, the developing device 10 adds toner to the image, the transfer charger 11 transfers the image onto the sheet, and the fuser 12 heats and fuses the image.

The sheet with the image thus formed is sequentially carried out of the main-body sheet discharge outlet 18. "13" shown in the figure denotes a circulating path, and is a path for two-side printing for reversing the side of the sheet printed on the front side from the fuser 12 via a main-body switchback path 14, then feeding the sheet to the image formation section 7 again, and printing on the backside of the sheet. Thus two-side printed sheet is carried out of the main-body sheet discharge outlet 18 after the side of the sheet is reversed by the main-body switchback path 14.

"20" shown in the figure denotes an image reading section, scans an original document sheet set on a platen 12 with a scan unit 22, and electrically reads the sheet with a photoelectric conversion element not shown. For example, the image data is subjected to digital processing in an image processing section, and then, transferred to a data storing section 16, and an image signal is sent to the laser emitting device 9. Further, "25" shown in the figure denotes a feeder apparatus, and feeds original document sheets stored in a stacker 26 to the platen 21.

The image formation apparatus A with the above-mentioned configuration is provided with a control section (controller) not shown, and image formation conditions such as, for example, sheet size designation and color/monochrome printing designation and printout conditions such as number-of-copy designation, one-side/two-side printing designation, and scaling printing designation are set from a control panel 15.

Meanwhile, the image formation apparatus A is configured so that image data read by the scan unit 22 or image data transferred from an external network is stored in the data storing section 16, the data storing section 16 transfers the image data to buffer memory 17, and that the buffer memory 17 transfers a data signal to the printing head 9 sequentially.

Concurrently with the image formation conditions, a post-processing condition is also input and designated from the control panel 15. As the post-processing condition, for example, selected is a "printout mode", "staple binding mode", "sheet-bunch folding mode" or the like. The post-processing condition is set for the folding form in the sheet folding apparatus B as described previously.

[Post-Processing Apparatus]

Figure 2:
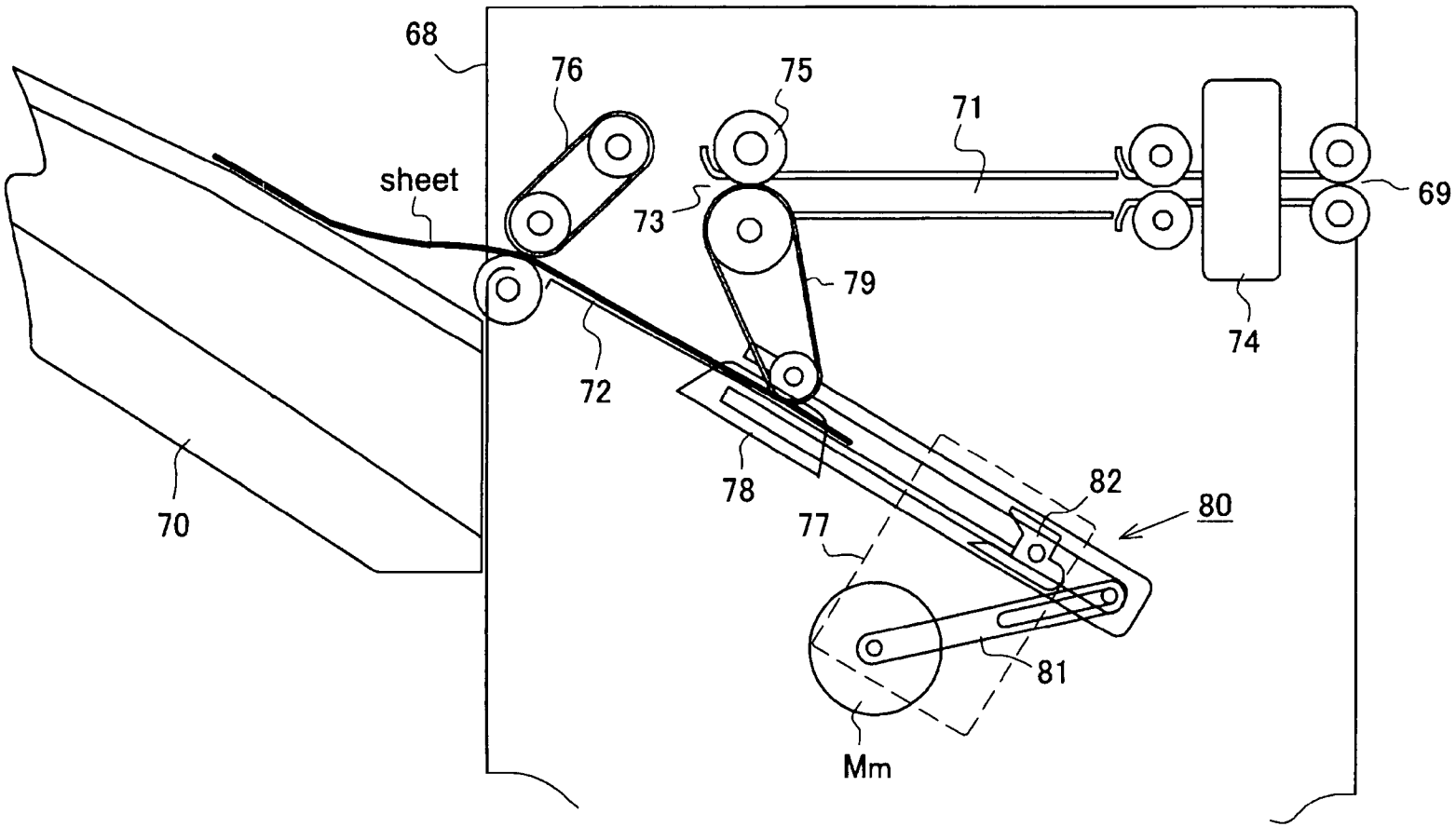
FIG. 2 is an enlarged explanatory view of principal part of a post-processing apparatus in the system of FIG. 1.

As shown in FIG. 2, the post-processing apparatus C is provided with the following configuration. This apparatus has a housing 68 provided with the sheet receiving opening 69, sheet discharge stacker 70, and post-processing path 71. The sheet receiving opening 69 is coupled to the carrying-out exit 31 of the sheet folding apparatus B, and is configured to receive a sheet from the first transport path 32 or the third transport path 36.

The post-processing path 71 is configured to guide the sheet from the sheet receiving opening 69 to the sheet discharge stacker 70, and a processing tray 72 is provided in the path. "73" shown in the figure denotes a sheet discharge outlet, and is to collect sheets from the post-processing path 71 in the processing tray 72 disposed on the downstream side. "74" shown in the figure denotes a punch unit, and is disposed in the post-processing path 71. A sheet discharge roller 75 is disposed in the sheet discharge outlet 73 to collect a sheet from the sheet receiving opening 69 in the processing tray 72.

On the processing tray 72, sheets from the post-processing path 71 are switch-back transported (in the direction opposite to the transport direction), and collated and collected using a rear end regulating member (not shown) provided on the tray. Therefore, above the tray is provided a forward/backward rotation roller 75 for switching back the sheet from the sheet discharge outlet 73. Further, the processing tray 72 continues to the sheet discharge stacker 70, and the sheet from the sheet discharge outlet 73 is supported (bridge-supported) on the front end side by the sheet discharge stacker 70 and on the rear end side by the processing tray 72.

On the processing tray 72 is disposed a stapler unit 77 for binding a sheet bunch positioned by the rear end regulating member. "78" shown in the figure denotes aligning means, and aligns the width of the sheet carried onto the processing tray in the direction orthogonal to the transport direction. "79" shown in the figure denotes a paddle rotating body, and is coupled to a rotary shaft of the sheet discharge roller 75 to be driven to carry the sheet from the sheet discharge roller 75 toward the rear end regulating member.

"80" shown in the figure denotes sheet bunch carrying-out means, and carries a sheet bunch bound by the stapler unit 77 to the sheet discharge stacker 70 on the downstream side. Therefore, the sheet bunch carrying-out means 80 shown in the figure is comprised of a lever member 81 axially supported at the base end portion to be swingable, and a sheet end engagement member 82.

Then, the sheet end engagement member 82 is equipped in the processing tray to reciprocate in the sheet discharge direction along the processing tray 72, and is coupled to the lever member 81. "Mm" shown in the figure denotes a driving motor for causing the lever member 81 to perform swinging motion. In addition, the sheet discharge stacker 70 is provided with an elevator mechanism, not shown, which moves up and down corresponding to a load amount of sheets.

Figure 16A:
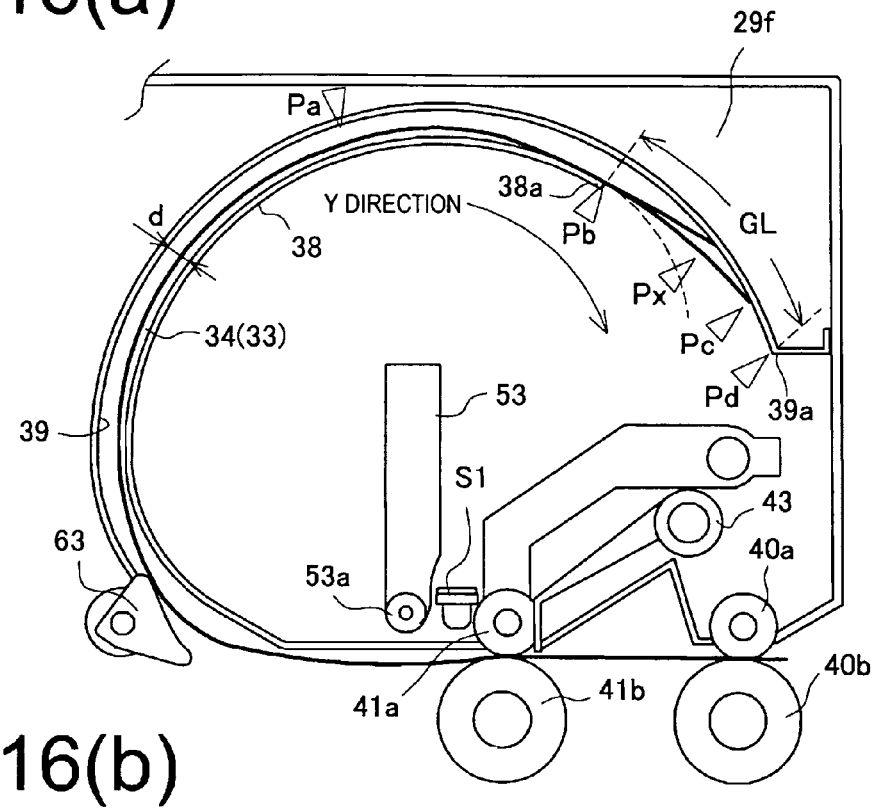
FIG. 16 contains explanatory views of another Embodiment of the first switchback path, where FIG. 16(*a*) shows a shape configuration of the path, FIG. 16(*b*) shows the front end portion of an inside guide member, and FIG. 16(*c*) is an explanatory view of providing a sheet with strength.
Figure 16B:
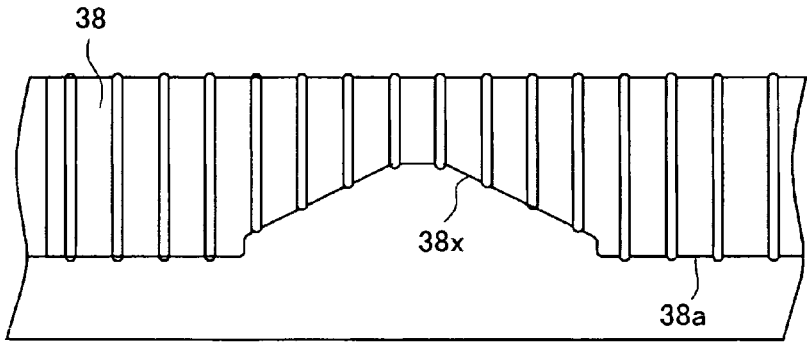
Figure 16C:
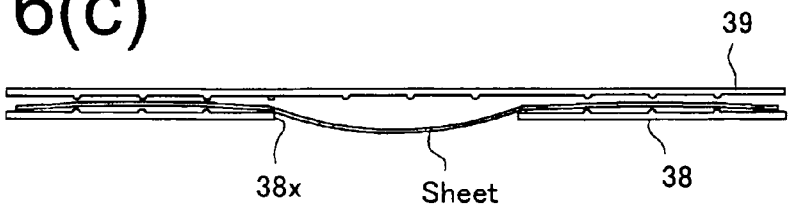

In addition, as another Embodiment of the first switchback path 34 of FIG. 3, it is possible to form the path as shown in FIG. 16.

Thus, as shown in FIG. 16, the curve-shaped first switchback path 34 is comprised of a pair of guide members 38, 39 having a sheet passage clearance d. Further, the inside guide member 38 positioned inside the curve shape and the outside guide member 39 positioned outside are configured as described below. In addition, the outside guide member 39 is formed of an apparatus frame 29*f*.

A transport-direction front end 38*a* of the inside guide member 38 is set to be shorter than a transport-direction front end 39*a* of the outside guide member 39, and is positioned on the upstream side in the sheet transport direction. As shown in FIG. 16(*a*), in order for a gap GL shown in the figure to be formed between the front end 38*a* of the inside guide member 38 and the front end 39*a* of the outside guide member 39, the front end 38*a* is shorter than the front end 39*a*, and is positioned on the upstream side in the sheet transport direction. This is because of reducing a friction load acting on a sheet moving between the guide members.

As in the conventional manner, when the front end of the inside guide member and the front end of the outside guide member are made the same length and curved with the small curvature, the sheet front end causes a paper jam. Accordingly, as the gap GL is set to be larger, the transport load imposed on the sheet is reduced. However, in order to guide a weak-nerve sheet, thin sheet, and curled sheet smoothly, it is necessary to set the front end length of the inside guide member 38 at an optimal length. For example, unless an extremely thin weak-nerve sheet is guided by the front end of the inside guide member 38, the sheet front end hangs inside the apparatus.

The front end length of the inside guide member 38 will further be described according to FIG. 16. "Pc" shown in the figure denotes a front end position (leading edge position of the guided sheet) of the maximum-size sheet, and the front end 39*a* of the outside guide member 39 is set to be longer than the front end position Pc, and set at a position Pd shown in the figure (Pd>PC). The sheet is guided by the inner wall of the inside guide member 38 in an inflection point Pa, and the sheet front end reaches the front end position Pc along the inner wall of the inside guide member 38. At this point, a guide position Pb of the front end 38*a* of the inside guide member acts to support the sheet from below. In other words, the sheet is deformed in a curved shape by guide positions Pa, Pb, Pc shown in the figure, and guided from the upstream side to the downstream side.

At this point, when the sheet is thin and weak in nerve, the sheet hangs in the dashed-line state shown in the figure, and may break or graze in the switchback inversion. Therefore, in the invention, the front end 38*a* of the inside guide member is set to be shorter than the front end 39*a* of the outside guide member by a gap GL, and concurrently, the inside guide member 38 deforms the sheet to provide strength.

In deforming the sheet while providing strength, as shown in FIG. 16(*c*), the sheet is distorted in the direction orthogonal to the transport direction by the inside guide member 38. Therefore, a concave recess portion comprised of a cut 38*x* is formed in the front end 38*a* of the inside guide member 38 (see FIG. 16(*b*)). By the concave recess portion (cut) 38*x*, in the process during which the sheet front end moves in the Y direction shown by the arrow in FIG. 16(*a*) along the inside guide member 38, a strong-nerve sheet is curved along the outside guide member 39. However, a weak-nerve sheet hangs in the dashed-line state as shown in FIG. 16(*a*) (when the concave recess portion 38*x* does not exit.)

However, since the concave recess portion 38*x* is formed in the front end 38*a* of the inside guide member, the sheet front end moves along the outside guide member 39, and is always engaged and supported by the front end 38*a* of the inside guide member in the curving point (Px shown in FIG. 16(*a*)) in which the weak-nerve sheet hangs. At this point, since the concave recess portion (cut) 38*x* is formed in the center in the transport-orthogonal direction in the inside guide member 38, the sheet is distorted and deformed in the center portion as shown in FIG. 16(*c*). The sheet is provided with strength by this deformation, and the sheet front end is guided to the leading edge position Pc along the outside guide member 39. Accordingly, even a weak-nerve sheet is neither curved in the dashed-line state shown in the figure nor hangs, and is guided in the curved state along the outside guide member 39.

In the guide members 38, 39 for curving the sheet, one of the guide members i.e. the inside guide member 38 is formed to be shorter, it is thereby possible to prevent a paper jam of the curved sheet front end portion and to reduce the transport load, and damage by hanging of the sheet front end is prevented by forming the concave recess portion (cut) 38*x* in the inside guide member 38. Accordingly, it is possible to reduce the transport load and guide the sheet without causing transport failure with a simplified structure at low cost.

In addition, this application claims priority from Japanese Patent Application No. 2009-250999, Japanese Patent Application No. 2009-251000, and Japanese Patent Application No. 2010-123211 incorporated herein by reference.

What is claimed is:

1. A sheet folding apparatus for performing folding processing on a sheet from a carry-in entrance to carry out to a carrying-out exit, comprising:

a first transport path having a substantially linear path, for guiding the sheet fed from the carry-in entrance to the carrying-out exit without performing the folding processing;

a second transport path for performing the folding processing on the sheet from the carry-in entrance; and a folding processing device disposed in a folding position in the second transport path to fold the sheet from the carry-in entrance, wherein the second transport path is disposed to cross the first transport path, and comprises a path end portion for guiding the sheet to the folding position, and another path end portion for guiding the folded sheet from the folding position to a downstream side, and the path end portion and the another path end portion are disposed inside the sheet folding apparatus opposite to each other relative to the first transport path.

2. The sheet folding apparatus according to claim 1, wherein the path end portion for guiding the sheet in the second transport path to the folding position carries in the sheet fed from the carry-in entrance while branching off from the first transport path, and reverses a transport direction of the sheet to carry out to the folding position.

3. The sheet folding apparatus according to claim 1, wherein the first transport path is formed of a path disposed substantially in a horizontal direction to guide the sheet fed from the carry-in entrance to the carrying-out exit, and in the second transport path, the path end portion for guiding the sheet to the folding position is disposed above the first transport path, while the another path end portion for guiding the folded sheet from the folding position to the downstream side is disposed below the first transport path.

4. The sheet folding apparatus according to claim 1, wherein the folding processing device comprises a plurality of folding roll pairs, coming into press-contact with one another, forming a first nip portion for first folding the sheet and a second nip portion for second folding the sheet, the second transport path comprises a first switchback path for guiding a front end of the sheet to insert a fold position of the sheet in the first nip portion, and a second switchback path for guiding the front end of the folded sheet to insert a fold position of the sheet in the second nip portion, and the first switchback path and the second switchback path are disposed opposite to each other via the first transport path.

5. The sheet folding apparatus according to claim 4, wherein in the second transport path, each of the first switchback path and the second switchback path comprises a substantially arc-shaped curved path.

6. The sheet folding apparatus according to claim 5, wherein the first switchback path and the second switchback path constituting the second transport path are disposed in a shape of an S above and below the first transport path.

7. The sheet folding apparatus according to claim 5, wherein a path length of the first switchback path is configured to be longer than a path length of the second switchback path.

8. The sheet folding apparatus according to claim 5, wherein each of the first switchback path and the second switchback path comprises the substantially arc-shaped path, and a curvature of the first switchback path is configured to be larger than a curvature of the second switchback path so as to reduce frictional resistance imposed on the sheet passing.

9. The sheet folding apparatus according to claim 4, further comprising a sheet discharge path disposed in the second switchback path, for carrying out the folded sheet fed from the folding processing device, and a storage stacker for storing the folded sheet fed from the sheet discharge path, and the sheet discharge path includes a substantially arc-shaped path curved in a direction opposite to the second switchback path.

10. The sheet folding apparatus according to claim 9, wherein the sheet discharge path comprises the substantially arc-shaped path curved in the direction opposite to the second switchback path, and a curvature of the sheet discharge path is configured to be smaller than a curvature of the second switchback path.

11. The sheet folding apparatus according to claim 4, wherein the first transport path comprises the substantially linear path across an apparatus housing, the first switchback path is disposed above the first transport path, the second switchback path is disposed below the first transport path, and a storage stacker for storing the folded sheet is disposed below the second switchback path.

12. The sheet folding apparatus according to claim 4, wherein the first switchback path comprises an inside guide member positioned inside a shape of a curve for curving a front end portion of the sheet, and an outside guide member positioned outside, a front end of the inside guide member is configured to be shorter than a front end of the outside guide member to be positioned on the upstream side in the transport direction, and the front end portion of the inside guide member includes a concave recess portion for distorting and deforming the front end portion of the sheet to provide strength.

13. The sheet folding apparatus according to claim 12, wherein the concave recess portion comprises a cut formed in a center portion orthogonal to the sheet transport direction of the inside guide member, and distorts and deforms the center portion of the front end of the sheet to cause the sheet to go forward in the curved direction along the outside guide member.

14. The sheet folding apparatus according to claim 12, wherein in the inside guide member and the outside guide member, the front end of the inside guide member is set to be shorter than a front end of a longest sheet to guide, and the front end of the outside guide member is set to be longer than the front end of the longest sheet.

15. The sheet folding apparatus according to claim 12, further comprising:

an apparatus frame, wherein the outside guide member is provided in the apparatus frame.

16. The sheet folding apparatus according to claim 1, wherein a post-processing unit that collates and collects sheets from the first transport path and the second transport path to bind is connected on a downstream side of the carrying-out exit.

17. An image formation system comprising:

an image formation apparatus for sequentially forming an image on a sheet; and a sheet folding apparatus for folding the sheet from the image formation apparatus, wherein the sheet folding apparatus has a configuration as described in claim 1.

18. A sheet folding apparatus for performing folding processing on a sheet from a carry-in entrance to carry out to a carrying-out exit, comprising:

a first transport path for guiding the sheet fed from the carry-in entrance to the carrying-out exit without performing the folding processing;

a second transport path for performing the folding processing on the sheet from the carry-in entrance; and a folding processing device disposed in a folding position in the second transport path to fold the sheet from the carry-in entrance, wherein the second transport path is disposed to cross the first transport path, and comprises a path end portion for guiding the sheet to the folding position and another path end portion for guiding the folded sheet from the folding position to a downstream side, the path end portion and the another path end portion are disposed inside the sheet folding apparatus opposite to each other relative to the first transport path, the second transport path is connected to a third transport path for guiding the sheet subjected to the folding processing to the carrying-out exit, the second transport path crosses the first transport path in a first cross portion to carry in the sheet fed from the carrying-in entrance, the third transport path crosses in a second cross portion to carry out the folding processing sheet toward the carrying-out exit, and a path switching device for switching a transport direction of the sheet is disposed in the first cross portion and the second cross portion.

19. The sheet folding apparatus according to claim 18, wherein the path switching device comprises a path switching member that enters inside and retracts from the first transport path, and the path switching member is configured to guide the sheet fed from the first transport path to the second transport path by a front side thereof, and further guide the sheet fed from the third transport path to the first transport path by a back side thereof.

20. The sheet folding apparatus according to claim 19, wherein the path switching member comprises a first guide attitude for guiding the sheet, which is fed to the first transport path from the carry-in entrance, to the carrying-out exit without performing the folding processing, a second guide attitude for guiding the sheet, which is fed to the first transport path from the carry-in entrance, to the second transport path, while further guiding the sheet fed from the third transport path to the first transport path, and a driving device for shifting a position between the first guide attitude and the second guide attitude.

21. The sheet folding apparatus according to claim 20, wherein the path switching member is disposed in a position for guiding the sheet fed from the second transport path to a nip portion of the folding processing device, in the second guide attitude for guiding the sheet fed from the carry-in entrance to the second transport path.

22. The sheet folding apparatus according to claim 21, wherein the second transport path and the third transport path are connected to form an open-loop-shaped path continuing to the second cross portion.

* * * * *